US009921540B2

(12) United States Patent
Amann et al.

(10) Patent No.: US 9,921,540 B2
(45) **Date of Patent: *Mar. 20, 2018**

(54) IMAGE FORMING DEVICE HAVING A SUPPLY ITEM THAT INCLUDES A RETAINER ASSEMBLY HAVING POSITIONING FEATURES FOR PROCESSING CIRCUITRY

(71) Applicant: LEXMARK INTERNATIONAL, INC., Lexington, KY (US)

(72) Inventors: Mark Amann, Lexington, KY (US); James Anthany Carter, II, Lexington, KY (US); Katrina Rosit Lactuan, Consolacion (PH); Matthew Jeremy Litman, Stamford, CT (US); Matthew Lee Rogers, Lexington, KY (US); Keith Seaman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/627,752

(22) Filed: Jun. 20, 2017

(65) Prior Publication Data

US 2017/0285517 A1 Oct. 5, 2017

Related U.S. Application Data

(63) Continuation of application No. 15/220,663, filed on Jul. 27, 2016, now Pat. No. 9,715,209, which is a (Continued)

(51) Int. Cl.

| | |
|---|---|
| ***G03G 21/16*** | (2006.01) |
| ***G03G 21/18*** | (2006.01) |
| ***G03G 15/08*** | (2006.01) |

(52) U.S. Cl.
CPC ..... *G03G 21/1652* (2013.01); *G03G 15/0863* (2013.01); *G03G 15/0865* (2013.01); (Continued)

(58) Field of Classification Search
CPC ..... G03G 15/0863; G03G 15/0865; G03G 15/80; G03G 21/1676; G03G 21/1652; (Continued)

(56) References Cited

U.S. PATENT DOCUMENTS 8,879,953 B2 * 11/2014 Amann ..... G03G 15/0863 399/111

OTHER PUBLICATIONS

U.S. Appl. No. 15/627,773, filed Jun. 20, 2017 (Amann et al.).
U.S. Appl. No. 15/627,797, filed Jun. 20, 2017 (Amann et al.).

* cited by examiner

*Primary Examiner* — Sophia S Chen

(57) ABSTRACT

An electrophotographic image forming device includes a replaceable unit that has a housing having an internal reservoir for storing toner. A circuit board retainer is positioned on an exterior surface of the housing. The retainer includes a top having an undersurface having first and second supports extending away from the undersurface of the top toward a bottom of the retainer. A mounting platform is positioned on the undersurface of the top intermediate the first and second supports and spaced apart from the bottom of the retainer. A circuit board is mounted on the mounting platform. The top and the first and second supports form an opening at the front of the retainer sized to receive an electrical connector of the image forming device for mating with the circuit board when the replaceable unit is installed in the image forming device.

20 Claims, 14 Drawing Sheets

Related U.S. Application Data continuation of application No. 14/854,406, filed on Sep. 15, 2015, now Pat. No. 9,429,899, which is a continuation of application No. 14/489,527, filed on Sep. 18, 2014, now Pat. No. 9,170,559, which is a continuation of application No. 13/532,186, filed on Jun. 25, 2012, now Pat. No. 8,879,953.

(52) U.S. Cl.
CPC ..... *G03G 21/1867* (2013.01); *G03G 21/1885* (2013.01); *G03G 2221/1823* (2013.01)

(58) Field of Classification Search
CPC ..... G03G 21/1875; G03G 21/1867; G03G 21/1885; G03G 2215/0695; G03G 2221/163; G03G 2221/1647; G03G 2221/183; G03G 2221/1823
See application file for complete search history.

IMAGE FORMING DEVICE HAVING A SUPPLY ITEM THAT INCLUDES A RETAINER ASSEMBLY HAVING POSITIONING FEATURES FOR PROCESSING CIRCUITRY

CROSS REFERENCES TO RELATED APPLICATIONS

This patent application is a continuation of U.S. patent application Ser. No. 15/220,663, filed Jul. 27, 2016, entitled "Retainer Assembly Having Positioning Features for Processing Circuitry Used With an Image Forming Device Supply Item," which is a continuation of U.S. patent application Ser. No. 14/854,406, filed Sep. 15, 2015, now U.S. Pat. No. 9,429,899, issued Aug. 30, 2016, entitled "Replaceable Unit for an Image Forming Device Having a Retainer Assembly Having Positioning Features for Processing Circuitry," which is a continuation of U.S. patent application Ser. No. 14/489,527, filed Sep. 18, 2014, now U.S. Pat. No. 9,170,559, issued Oct. 27, 2015, entitled "Toner Cartridge for an Image Forming Device Having a Retainer Assembly Having Positioning Features for Processing Circuitry," which is a continuation of U.S. patent application Ser. No. 13/532,186, filed Jun. 25, 2012, now U.S. Pat. No. 8,879,953, issued Nov. 4, 2014, entitled "Retainer Assembly Having Positional Features for Processing Circuitry Used Within an Image Forming Device Supply Item."

BACKGROUND

1. Field of the Disclosure

The present disclosure relates generally to supply items used in electrophotographic image forming devices and more particularly to a retainer for containing processing circuitry mountable on a supply item in an imaging forming device and having positional control features.

2. Description of the Related Art

In order to reduce the premature replacement of components used in an image forming device, toner cartridge manufacturers have begun to separate components having a longer life from those having a shorter life into separate replaceable units. Relatively longer life components such as a developer roll, a toner adder roll, a doctor blade and a photoconductive drum are positioned in one replaceable supply item commonly referred to as an imaging unit. The image forming device's toner supply, which is consumed relatively quickly in comparison with the components housed in the imaging unit, is provided in a reservoir in a separate replaceable supply item in the form of a toner cartridge that mates with the imaging unit. In this configuration, the number of components housed in the toner cartridge is reduced in comparison with traditional toner cartridges.

Onboard such supply items, there is processing circuitry used to store information about the supply item such as life, printing variables, etc. The processing circuitry is mounted on a circuit board on the supply item such that the contacts on the circuit board mate with corresponding contacts in the image forming device when the supply item is installed in the image forming device. In order for the image forming device to communicate with the processing circuitry, electrical connection must be made between the processing circuitry on the supply item and the image forming device.

As such, it is important to accurately position the circuit board on the supply item relative to the connector contacts in the image forming device. This can be challenging in that circuit boards for this processing circuitry may have dimensional variation and few locating features. Also, the tolerances in the image forming device frame dimensions can lead to the connector contacts of the image forming device and the circuit board of supply item's processing circuitry not being properly positioned relative to each other. Further, to establish a reliable electrical connection, the contacts of the image forming device connector need to exert force on the supply item's processing circuitry circuit board. However, the force balance between the toner cartridge and the imaging unit is delicate because an imbalance of forces can cause print defects. Furthermore, these supply items can see many installations into a printer throughout their lives during which contaminants such as toner, paper dust, etc., can settle in the terminals of the circuit board of the supply item's processing device. These contaminants act like sandpaper when sandwiched between the image forming device's connecting pins and the contacts or terminals on processing circuitry circuit board which cause the contacting surfaces of the pins and the terminals to become worn and, in some cases, leads to a malfunction of the processing circuitry.

Accordingly, it will be appreciated that a retainer having positional control features that permit precise alignment for establishing a reliable electrical connection between the supply item's processing circuitry and the image forming device while minimizing external forces on the supply item and permitting the removal of contaminants from the contact surface of the processing circuitry circuit board is desired.

SUMMARY

In one example embodiment, a retainer assembly is mountable on an exterior surface of an insertable supply item of an image forming device. The retainer assembly comprises a circuit board having processing circuitry with a plurality of contacts and a retainer having a top having an undersurface having first and second supports depending therefrom and a mounting platform position intermediate the first and second supports. The mounting platform comprises a pair of opposed side walls positioned intermediate to the first and second supports and extending between a front and a rear of the retainer; the front facing a direction of insertion of the supply item into the image forming device and a rear wall positioned transversely to the pair of opposed side walls and adjacent the rear of the retainer, the pair of opposed side walls and transverse rear wall forming a cavity receiving the circuit board therein. A portion of the rear wall and a portion of at least one side wall of the pair of opposed side walls form a mounting plane, the circuit board being mounted in the mounting plane with the mounting plane spaced apart from the undersurface of the top and, when the retainer is mounted on the supply item, away from the outer surface of the supply item. The portions of the rear wall and the at least one side wall of the pair of opposed side walls further define a datum point locating a corner of the circuit board on the retainer and aligning the plurality of contacts of the circuit board with respect to the retainer. The top, the first and second supports define an opening sized to receive therebetween a connector mounted within the image forming device that is in electrical communication with a controller in the image forming device. The connector has a plurality of electrically conductive connecting pins. An attachment device for removably attaching the retainer to the supply item is provided; and, an alignment device is provided on the retainer that engages with a corresponding alignment device on the supply item to establish a reference datum for the retainer when installed on the supply item for aligning the retainer with the supply item. When the retainer assembly is mounted on the supply item and the supply item is inserted into the imaging apparatus, the first and second supports align the plurality of connecting pins of the connector with corresponding ones of the plurality of contacts of the circuit board for electrical interconnection with the controller.

Deformable ribs may be provided on one wall of the pair of opposed side walls forming an interference fit with a side edge of the circuit board that exerts a force on the circuit board to bias it against the other side wall of the pair of opposed side walls. Recesses may be provided on the pair of opposed side walls and the rear transverse wall with the respective bottom surfaces of the recesses forming the mounting plane for the circuit board within the cavity while a side surface of the recess in the rear wall and a side surface of the one side wall of the pair of opposed side walls form the datum point. A front transverse wall depending from the undersurface of the top may also be provided opposite the rear transverse wall and have a second plurality of deformable ribs forming an interference fit with a front edge of the circuit board and exerting a second force along the front edge of the circuit board to bias the circuit board against the rear transverse wall.

A mounting boss for the circuit board depending from the undersurface of the top within the cavity may also be provided. The mounting boss having a top surface being substantially coplanar with the mounting plane and receiving a fastener retaining the circuit board within the cavity. A conductive interlock for electrically shorting two connecting pins of the plurality of connecting pins of the connector may also be provided in the retainer.

BRIEF DESCRIPTION OF THE DRAWINGS

The above-mentioned and other features and advantages of the various embodiments, and the manner of attaining them, will become more apparent and will be better understood by reference to the accompanying drawings.

FIGS. 11A-16A, and 11B-16B are sequential views of a connector insertion into an example retainer during installation of the toner cartridge into the image forming unit of the image forming device.

FIGS. 11A-16A are partial side elevation views of the end cap of the toner cartridge and connector during insertion; in FIGS. 13A-16A, the top of example retainer has been removed to show connector insertion within the example retainer.

FIGS. 11B-16B are cross-sectional top views of the end cap, example retainer and connector during insertion of the toner cartridge into the imaging unit.

FIGS. 11A and 11B show a back surface of a connector mounted within the imaging forming device initially engaging an inclined surface on the end cap of the toner cartridge.

FIGS. 13A and 13B show the front end of the connector entering the front of the example retainer and starting to engage a cam surface on the end cap of the toner cartridge beneath the top of the example retainer.

FIGS. 16A and 16B show the connector pins and circuit board of the processing circuitry in their operating position with the toner cartridge coupled to the imaging unit in its operational position within the imaging forming apparatus.

DETAILED DESCRIPTION

Figure 1:
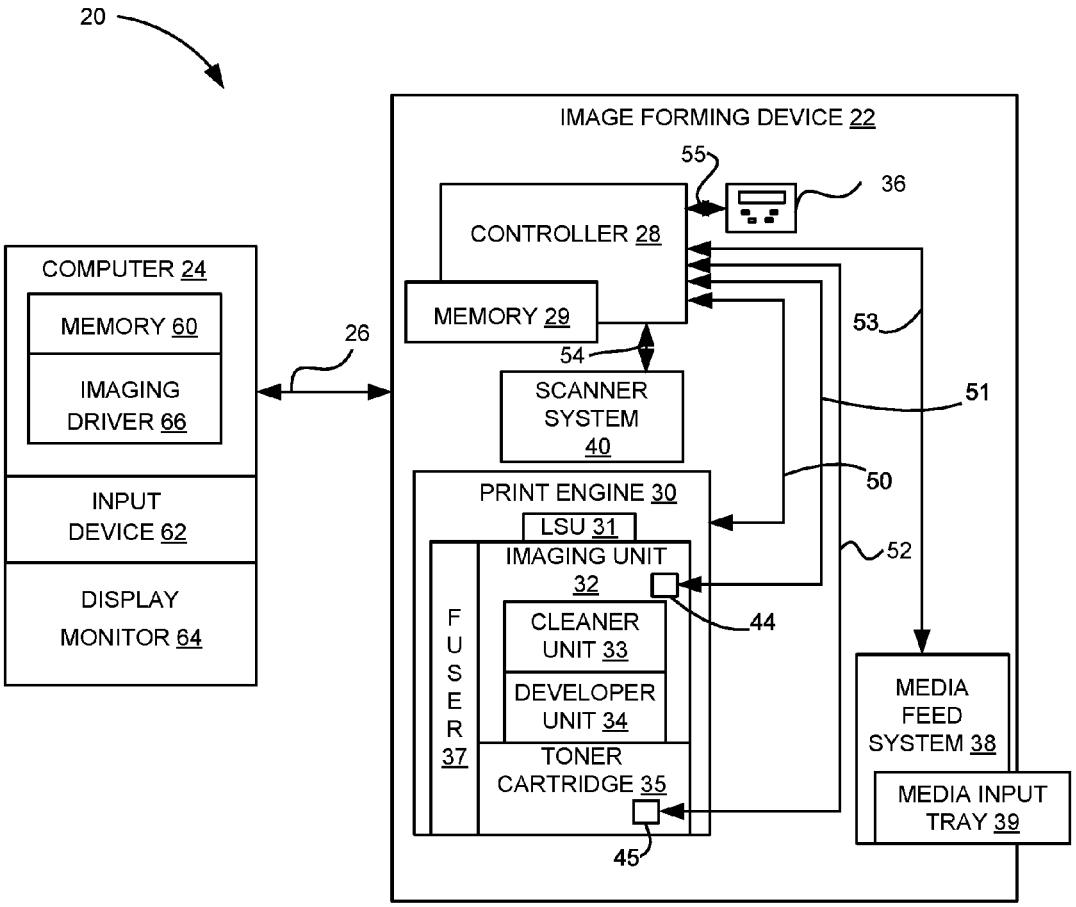
FIG. 1 is a block diagram of an imaging system according to one example embodiment.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory of combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any processing device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, network server, tablet computer, smartphone, or other hand-held electronic device including memory 60, such as volatile and/or non volatile memory, input device 62, such as a keyboard and/or a mouse, and a display, such as monitor 64. Computer 24 also includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and fuser 37, all mounted within image forming device 22. Imaging unit 32 and toner cartridge 35 are supported in their operating positions by a frame 90 (see FIG. 3) which allows for toner cartridge 35 to be operatively mated to the imaging unit 32 while minimizing any unbalanced loading forces by the toner cartridge 35 on imaging unit 32. Imaging unit 32 is removably mounted in the frame 90 of image forming device 22 and includes a developer unit 34 that houses a toner sump and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in the frame 90 of imaging unit 32 in a mating relationship with developer unit 34 of imaging unit 32. An exit port on toner cartridge 35 communicates with an entrance port on developer unit 34 allowing toner to be periodically transferred from toner cartridge 35 to resupply the toner sump in developer unit 34. Both imaging unit 34 and toner cartridge 35 are replaceable supply items for imaging forming device 22.

The electrophotographic imaging process is well known in the art and, therefore, will be briefly described. During an imaging operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39. Next the toned image is fused to the media sheet in a fuser 37 and sent to an output location or to one or more finishing options such as a duplexer, a stapler or a hole-punch. Toner remnants are removed from the photoconductive drum by the waste toner removal system housed within cleaner unit 33. As toner is depleted from developer unit 34, it is transferred from toner cartridge 35 into developer unit 34. Controller 28 provides for the coordination of these activities occurring during the imaging process.

Figure 2:
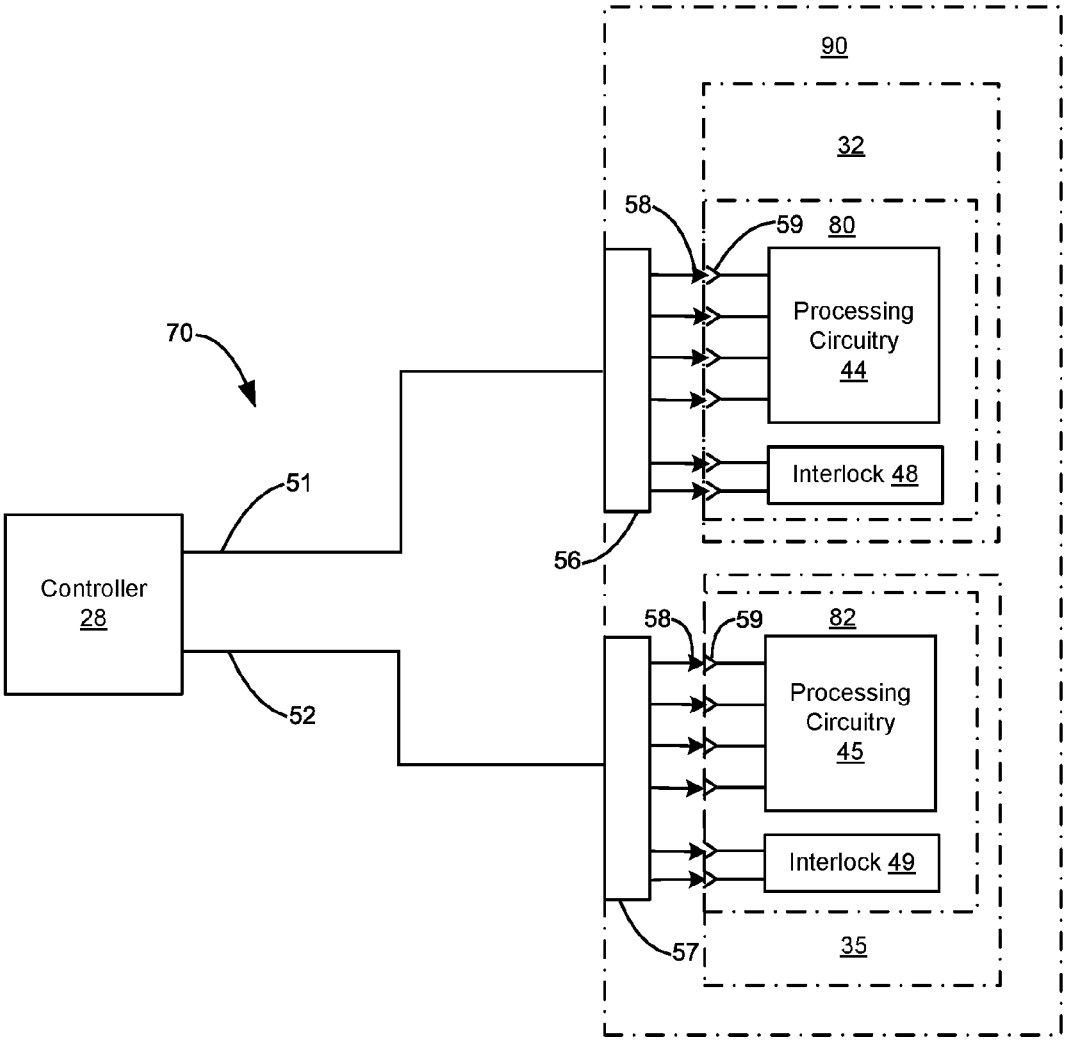
FIG. 2 is a simplified schematic diagram of the connectors, processing circuitry and controller of the image forming device.

With reference to FIG. 2, a simplified circuit 70 of the connection between controller 28 and first and second processing circuitry 44, 45 is shown, mounted in retainers 80, 82 on imaging unit 32 and toner cartridge 35, respectively. First and second connectors, 56, 57, mounted on a mounting frame 90 (shown in phantom lines), are provided in communications links 51, 52, respectively, to engage with processing circuitry 44, 45 respectively. Mounting frame 90 is typically formed of a metal plate having at least two spaced and aligned side panels containing rails or channels 94-97 (see FIG. 3) that are used to support imaging unit 32 and toner cartridge 35. Other combinations of materials including plastic may be used to fabricate mounting frame 90. First and second connectors 56, 57, are positioned on mounting frame 90 adjacent the operating positions of imaging unit 32 and toner cartridge 35, respectively, within image forming device 22 and engage with retainers 80, 82 and processing circuitry 44, 45 as discussed in more detailed herein.

Each of first and second connectors 56, 57 has a plurality of connecting pins 58 engaging a corresponding plurality of contact pads or terminals 59 provided at processing circuitry 44, 45. In an example embodiment, each of processing circuitry 44, 45 has four terminals 59 providing connections for ground, power, and data communications such as a 2-wire bus. As shown, two additional connecting pins 58 and terminals 59 interconnect optional interlocks 48, 49 to controller 28. The number of connecting pins 58 and terminals 59 is a matter of design choice. Interlocks, 48 49 are provided to ensure that imaging unit 32 and toner cartridge 35 are both installed in their respective operating positions within image forming device 22 before the laser in the LSU 31 can be turned on. In one form, interlocks, 48, 49 are metal shorting bars mounted on imaging unit 32 and toner cartridge 35 that interconnect or short two corresponding connecting pins in connectors 56, 57, respectively. If both pairs of connecting pins are not shorted, the power path to the laser is open and the laser cannot turn on. Other forms for interlocks 48, 49 such as, optical interrupters, capacitive or inductive sensors, may be used and are a matter of design choice.

As is known, the mounting frame 90 is used to establish the spatial relationship of the imaging unit 32, in particular, the photoconductive drum, to either the media to be printed or to the intermediate transfer member onto which the toned image on the photoconductive drum is transferred and to its connector 56. The mounting frame 90, along with positioning features on toner cartridge 35, establishes the spatial relationship of toner cartridge 35 to imaging unit 32 and to its connector 57. In turn, alignment features on each of the imaging unit 32 and toner cartridge 35 engage with respective alignment features found on retainers 80, 82 for referencing retainers 80, 82 to imaging unit 32 and toner cartridge 35, respectively. Last, positioning features on retainers 80, 82 locate the circuit boards for processing circuitry 44, 45, and optional interlocks 48, 49 on retainers 80, 82 allowing connectors 56, 57 to mechanically and electrically engage with processing circuitry 44, 45 and interlocks 48, 49, respectively.

Figure 3:
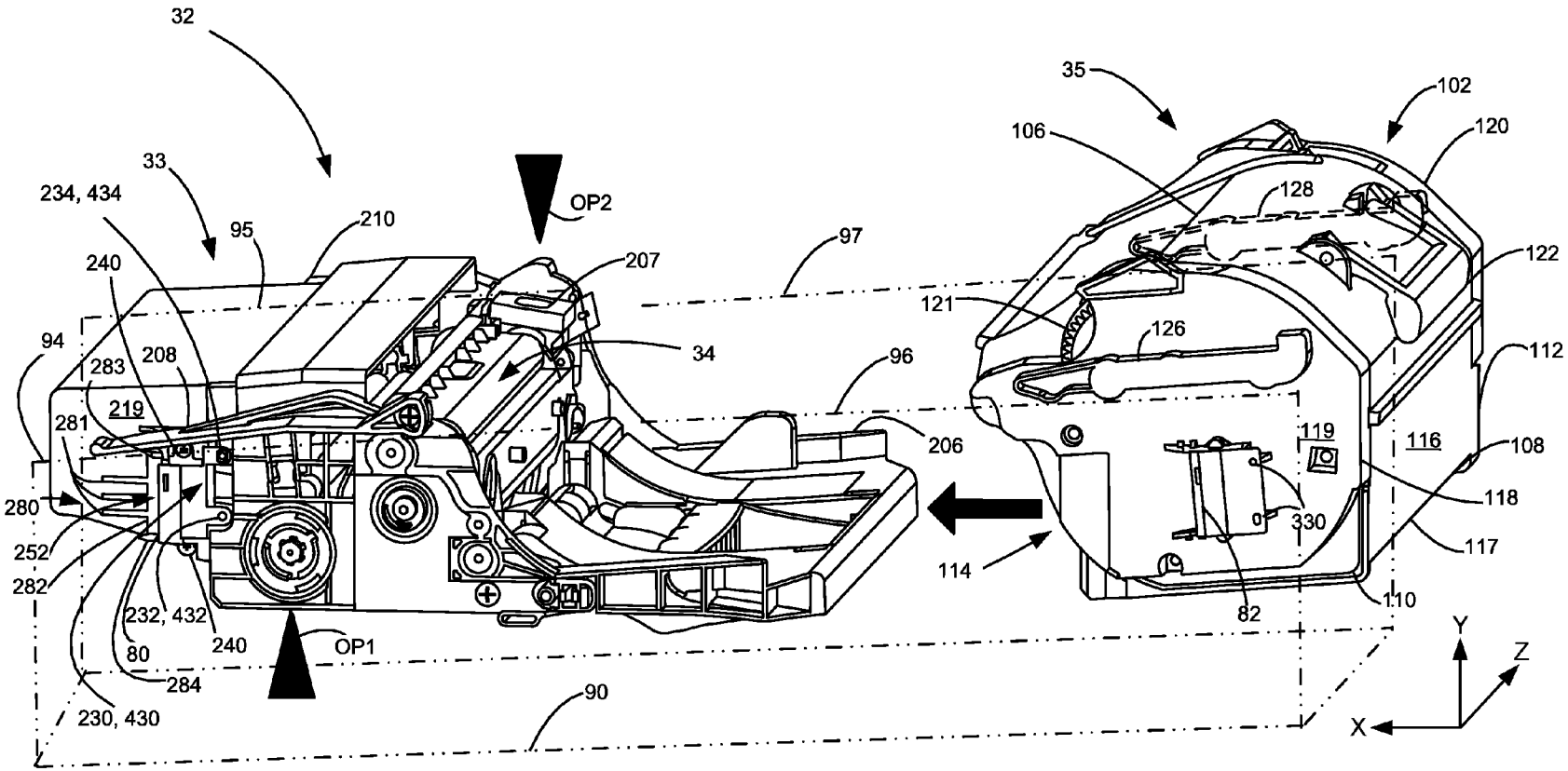
FIG. 3 is a perspective view of an example toner cartridge and an imaging unit in a frame.

Referring now to FIG. 3, a toner cartridge 35 and an imaging unit 32 are shown according to one example embodiment. Imaging unit 32 includes a developer unit 34 and a cleaner unit 33 attached to frame 206. Imaging unit 32 may be first slidably inserted into a mounting frame 90 within image forming device 22 in the insertion direction indicated by the arrow. Imaging unit 32 is shown in its operating position OP1 designated by the black triangle. Imaging unit 32 may be provided with a pair of wing guides 208, 210 mounted on both sides of frame 206 and or cleaner unit 33 for guiding imaging unit 32 through the insertion path and for positioning the imaging unit 32 within the mounting frame of image forming device 22. Wing guides 208, 210 are supported in channels or rails 94, 95, indicated by phantom lines, in the side plates of the mounting frame 90.

Toner cartridge 35 is shown being inserted into the mounting frame in the indicated insertion direction where it is guided by frame 206 into a mating relationship with developer unit 34 of imaging unit 32 at its operating position OP2 designated by the black triangle. At operating position OP2 an exit port on the front wall 114 and adjacent second side wall 112 of toner cartridge 35 is aligned with the inlet port 207 of developer unit 34. A pair of guides 126, 128 is provided on the sides of toner cartridge 100 and is supported in channels or rails 96, 97, indicated by phantom lines in the mounting frame 90. This arrangement allows toner cartridge 35 to be removed and reinserted easily, such as when replacing an empty toner cartridge 35, without having to remove imaging unit 32. While rails or channels 94, 96 and 95, 97 are shown as being separate, rails or channels 94, 96 and 95, 97 may be one continuous rail or channel in the mounting frame.

Should a media jam occur beneath the imaging unit 32, the toner cartridge 35 and the imaging unit 32 may be readily removed to allow access to the media jam. The developer unit 34, cleaner unit 33 and frame 206 may also be readily removed as desired in order to maintain, repair or replace the components associated with developer unit 34, cleaning unit 33 or frame 206. However, it will be appreciated that this typically occurs with less frequency than the removal and reinsertion of toner cartridge 35.

Toner cartridge 35 includes a housing 102 having an enclosed reservoir for holding a quantity of toner therein. Housing 102 may be viewed as having a top or lid 106 mounted on a base 108. Base 108 is formed by first and second side walls 110, 112 connected to adjoining front and rear walls 114, 116 and bottom 117. In one embodiment, top 106 is ultrasonically welded to base 108 thereby forming the enclosed toner reservoir. Housing 102 also includes first and second end caps 118, 120 that are mounted to side walls 110, 112, respectively. First and second end caps 118, 120 may be snap fitted into place or attached by screws or other fasteners onto base 108. Various gears and or linkages are housed within the space between end cap 118 and side wall 110 and between end cap 120 and side wall 112. These gears and linkages are used for operation of interlocks that engage with the imaging unit 32 and for operation of a toner delivery system within toner cartridge 35 that includes a toner paddle assembly, feed auger, gear train, and exit port shutter for toner cartridge 35. A main interface gear 121 for toner cartridge 35 is mounted in end cap 118. Main interface gear 121 receives torque from a drive system housed within image forming device 22 and in turn drives the feed auger and the toner paddle assembly through one or more intermediate gears for the delivery of toner from toner cartridge 35. A handle 122 may be provided on top 106 or base 108 of toner cartridge 35 to assist with insertion and removal of toner cartridge 35 from imaging unit 32 and image forming device 22. Guides 126, 128 are shown mounted on the first and second end caps 118, 120, respectively.

Referring to FIGS. 3-7 and 9, mounted on each of imaging unit 32 and toner cartridge 35 is a retainer 80, 82, respectively. Provided on mounting frame 90, are corresponding connectors 56, 57 for each retainer 80, 82 at or at a predetermined offset position adjacent to the operational positions OP1, OP2 of imaging unit 32 and toner cartridge 35, respectively. Retainer 82 houses circuit board 380 and, if present, interlock 49. As shown, circuit board 380 has four contact pads 382-385 that each connect to processing circuitry 45 (see FIGS. 9, 13B) and engage with corresponding connecting pins from connector 57. According to example embodiments, the features of retainers 80, 82 are similar and for the sake of brevity, only the features of retainer 82 will be described in detail. The primary difference between retainers 80, 82 is in the location of the attachment features on retainer 80 used to mount retainer 80 onto imaging unit 32. Unless otherwise noted herein, the features and functionality of retainers 80, 82 are identical. Similarly, only the features for connector 57 that engages with retainer 82 will be described herein as connector 56 is substantially the same.

Figure 4:
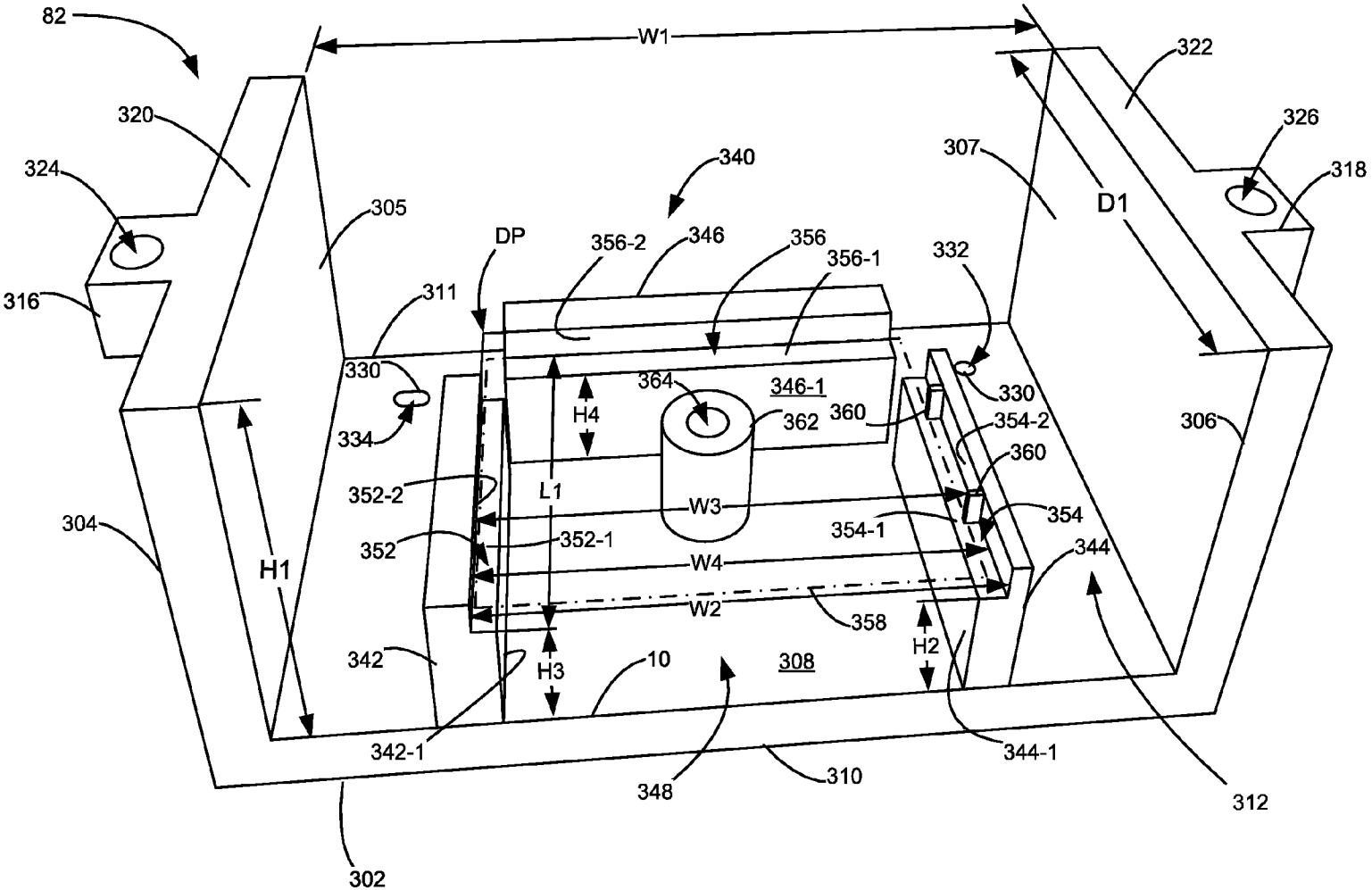
FIG. 4 is a perspective view of the alignment and mounting features on the undersurface of the top of one example configuration for an example retainer.

Example retainer 82 is discussed with reference to FIGS. 4-6. Viewed in FIG. 4 is retainer 82 in an inverted position for showing the support and alignment structures provided thereon. Retainer 82 comprises a top 302 having a first and second supports 304, 306, depending from an undersurface 308 thereof. First and second supports 304, 306 are spaced apart a distance W1 to accommodate the width of the portion of the body of connector 57 that will be inserted between inner surfaces 305, 307 of supports 304, 306, respectively. At the front 310 of retainer 82, an opening 312 is formed by top 302, first and second supports 304, 306 and is enclosed by the outer surface 119 of end cap 118 when retainer 82 is installed. The depth D1 and height H1 of supports 304, 306 is made so that the depth and height of the portion of the body of connector 57 and its connecting pins that are inserted into opening 312 of retainer 82 can be accommodated in the space 314 (see FIG. 5) between the contact pads 382-385 and the outer surface 119 of end cap 118. Example depths D1 are in the range of 12 mm to 16 mm. Example heights H1 are in the range of 6 mm to 10 mm. Example widths W1 are between 10 mm to 30 mm. Attachment devices, such as attachment tabs 316, 318 are provided on the distal ends 320, 322 of supports 304, 306, respectively. Holes 324, 326 are provided in attachment tabs 316, 318, respectively for receiving fasteners 140, such as screws 140, to attach retainer 82 to the outer surface 119 of end cap 118 (see FIG. 5). The fasteners 140 pass through corresponding holes 142 in end cap 118 (See FIG. 10). The location and size of attachment tabs 316, 318 and the fasteners 140 used is a matter of design choice. In lieu of or in addition to attachment tabs 316, 318, holes 324, 326 may also be provided in the distal ends 320, 322 for attaching retainer 82 to toner cartridge 35. Other attachment locations for retainer 82 onto toner cartridge 35 may be used provided connector 57 is correspondingly positioned.

One or more alignment devices 330 on retainer 82 and corresponding one or more alignment devices 130 (see FIGS. 10 and 17A-17E) on toner cartridge 35 are used to align or reference retainer 82 to toner cartridge 35. Similar alignment devices 230 on imaging unit 32 and corresponding alignment devices 430 on retainer 80 align retainer 80 to imaging unit 32. Holes 142 in end cap 118 for screws 140 are not used to reference or position retainer 82 to toner cartridge 35 due to tolerance stackup between screws 140 and holes 142 and because of erosion of holes 142 due to the insertion and removal of screws 140 caused by attachment and disattachment of retainer 82. This similarly applies to the holes provided in imaging unit 32 used by screws 240 to attach retainer 80 to side wall 219.

Alignment devices 130, 230 generally comprise, in one example form, at least two spaced cylindrical posts 132, 134, and 232, 234, respectively, projecting outwardly from the outer surface 119 of end cap 118 and the outer side surface 219 of cleaner unit 33. Posts 132, 134 define a reference datum or line on toner cartridge 35 that positions retainer 82 so that the contacts 382-385 are substantially parallel to the connecting pins of connector 57 when inserted therein. In retainer 82, hole 332 and slot 334 are spaced to correspond to posts 132, 134, respectively. The distal ends of posts 132, 134 are closely received into hole 332, and slot 334, respectively, when retainer 82 is attached to end cap 118. Slot 334 allows for any tolerance variations in the positioning of posts 132, 134 or in retainer 82 to be accommodated. Hole 332 and slot 334 may be blind openings (see FIG. 9) in top 302 or may being through openings (See FIG. 3). Through openings allow for visual confirmation that posts 132, 134 are properly received into hole 332, and slot 334. The tolerances of alignment devices 130, 330 are closely held (typically +/−0.03 mm) so that retainer 82 may be accurately referenced on toner cartridge 35. For retainer 80, the alignment devices 430 may be designed substantially the same as alignment devices 330. Hole 432, and slot 434 are spaced to correspond to receive the ends of posts 232, 234, respectively, projecting from side surface 219. The tolerances of alignment devices 230, 430 are similarly closely held (typically +/−0.03 mm) so that retainer 80 is accurately referenced on imaging unit 32. As explained with reference to FIGS. 17A-17E, other shapes and arrangements may be used for alignment devices 130, 230, 330, 430 and are a matter of design choice. While holes and slots are shown in retainers 80, 82, posts may be used on retainers 80, 82 with corresponding holes and slots provided in imaging unit 32 and toner cartridge 35, or combinations of posts and holes and or slots may be provided on retainers 80, 82 and imaging unit 32 and toner cartridge 35.

Retainer 82 provides a mounting platform on undersurface 308 for circuit board 380. The mounting platform, generally indicated by reference numeral 340, comprises three walls 342, 344, 346 that cantilever from undersurface 308. Side walls 342, 344 are opposed and extend between the front 310 and rear 311 of retainer 82 and, as illustrated, are generally parallel with supports 304, 306. Back wall 346 is transverse to opposed side walls 342, 344. Walls 342, 344, 346 generally form a cavity or pocket 348 that is U-shaped with an open end facing the front 310 of retainer 82. Ledges or recesses 352, 354, 356 are formed along the upper portion of the interior surfaces 342-1, 344-1 and 346-1 of walls 342, 344, 346 to provide for mounting of a circuit board 380 having processing circuitry 45. The heights H2, H3, H4 ledges 352, 356, 356, respectively as shown as being the same and are sized so that components mounted on the circuit board may be accommodated within cavity 348.

At least two of bottom surfaces 352-1, 354-1, 356-1 of ledges 352, 354, 356, establish a mounting plane 358 for circuit board 380, when mounted thereon. The intersection of the plane of side surface 356-1 of ledge 356 with one of the planes of side surfaces 352-2, or 354-2 establishes a datum point DP for locating a corner of circuit board 380 on retainer 82. As illustrated, the datum point DP is shown at the intersection of the planes of side surfaces 352-2 and 356-2. Rear and side edges 390, 391 of circuit board 380 would abut rear and side surfaces 356-2, 352-2, respectively, when installed in retainer 82. It should be realized that while ledges or recesses are shown in walls 342, 344, 346, rails or other extensions may be used to support circuit board 380 and establish mounting platform 340. As illustrated, circuit board 380 is mounted so that its contact surface side 386 faces away from undersurface 308 while its component surface side 387 having processing circuitry 45 mounted thereon would be housed in cavity 348. (See FIGS. 8, 11B).

To accommodate for tolerance stackup between the width of circuit board 380 and side walls 342, 346, one of the side walls is provided with deformable features 360. As illustrated in FIG. 4, side wall 344 has a least one rib 360 extending out from side surface 354-2, two ribs 360 are shown. In one example, ribs 360 extend approximately 0.5 mm into bottom surface 354-1 from side surface 354-2. The number of ribs 360 and the amount of extension is a matter of design choice. The width of circuit board 380 will be greater than a width W4 between side surface 352-2 and interior surface 344-1 and less than width W2 between side surfaces 352-2 and 354-2. The width of one example circuit board 380 may be 11 mm+/−0.25 mm. The width W3 between the distal ends of ribs 360 and side surface 352-1 will be greater than width W4 but less than width W2. When circuit board 380 is installed in cavity 348, side edge 392 thereof causes ribs 360 to deform and form an interference fit with circuit board 380 as circuit board 380 is pressed into contact with bottom surfaces 352-1, 354-1, 356-1. This ensures that opposite side edge 391 of circuit board 380 abuts side surface 352-1. A mounting boss 362 having opening 364 is provided in cavity 348. A fastener 393, such as a screw, passes through an opening 394 in circuit board 380 to secure circuit board 380 in cavity 348 and onto mounting platform 340. When installed, the component surface 387 of circuit board 380 abuts bottom surfaces 352-1, 354-1, 356-1 and rear edge 390 abuts side surface 356-2. The top surface of mounting boss 362 may be positioned to be coplanar with mounting plane 358 or to be slightly below mounting plane 358.

Figure 7:
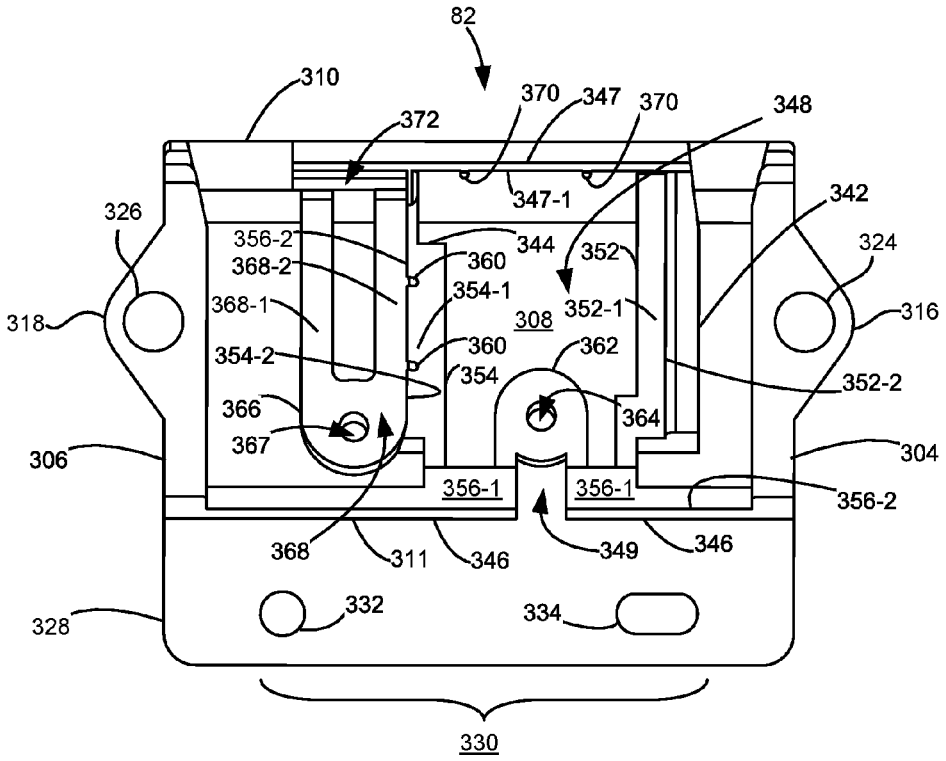
FIG. 7 is a plan view of the undersurface of an example retainer of FIG. 4 including an example interlock mount.
Figure 8:
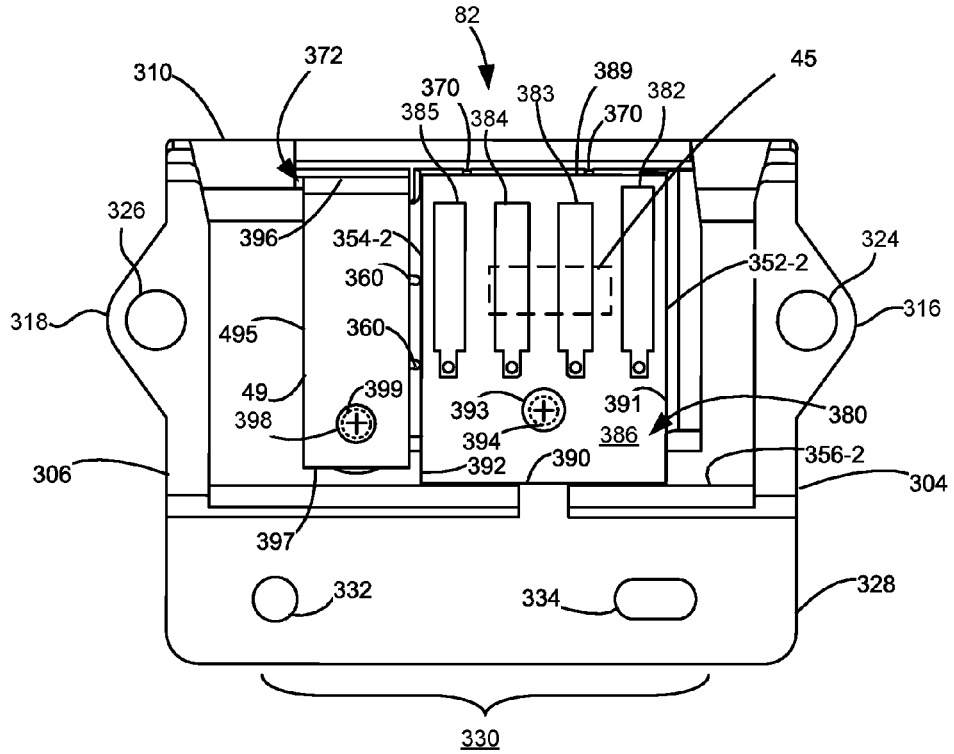
FIG. 8 is the example retainer of FIG. 7 having an interlock and a processing circuitry circuit board mounted thereon.

Shown in FIGS. 7 and 8 are additional positional features that may be provided in retainer 82. These include a front transverse wall 347 having a second set of deformable features 370, a second mounting boss 366 for interlock 49, and a mounting flange 328, onto which alignment features 330 have been moved, provided along the rear 311 of retainer 82.

As shown front wall 347 encloses the front of cavity 348. Deformable features 370, such as ribs 370, are provided on the interior surface 347-1 of front wall 347 within cavity 348 and function in a similar fashion to deformable features 360 except along the front edge 389 of circuit board 380 and form an interference fit with circuit board 380 to ensure that the rear edge 390 of circuit board 380 abuts side surface 356-2. As illustrated two spaced ribs 370 extend into cavity 348 from interior surface 347-1. Example ribs 370 may extend approximately 0.2 mm. Again, the amount of extension is a matter of design choice. Deformable features or ribs 360, 370 may be triangular, hemispherical, or rectangular in shape. It can be appreciated that ribs 360, 370 can have other shapes aside from those mentioned above to create an interference fit with the circuit board 380.

With circuit board 380 mounted within cavity 348, front wall 347 extends in height to about contact surface 386 or slightly beyond and provides protection from chipping for the front edge 389 of circuit board 380 during insertion of connector 57 into retainer 82. As shown, rear wall 346 has a cutout or recess 349 so that mounting boss 362 and rear wall 346 have approximately the same cross-sectional area. This enables these features to be more reliably molded. Further the cross-sectional areas of walls 342, 344, 347 and mounting boss 366 and legs 368-1, 368-2 are similar to that of rear wall 346 for this reason.

Walls 342, 344, 346 are shown as three individual segments however, one continuous wall having three segments as described may also be used, walls 342 and 346 may be joined where they would intersect one another or walls 344 and 346 may be joined. The top inner edges of walls 342, 344, 346, 347 and the top edges of ribs 360, 370 may be chamfered to facilitate the insertion and mounting of circuit board 380 into cavity 348.

Mounting boss 366 is illustrated as being formed as a lateral extension of side wall 344 and depending from undersurface 308. Mounting boss 366 provides a planar mounting surface 368 on its top shown as a pair of parallel legs 368-1, 368-1 attached to mounting boss 366. Mounting surface 368 may be one continuous plane and is generally coplanar with mounting plane 358 assuming that interlock 49 and circuit board 380 have similar thicknesses so that all of the contact surfaces on circuit board 380 and interlock 49 are coplanar. Adjacent free ends of legs 368-1, 368-1 is slot 372 provided in top 302 of retainer 82. Slot 372 may be a through slot or a blind slot, like hole 332 or slot 334. The body 395 of interlock 49 is generally a rectangular plane. The front end 396 of interlock 49 is bent and received into slot 372. The rear end 397 of interlock 49 attaches to mounting boss 366 by a fastener 398, such as a screw 398, passing through hole 399 therein and into hole 367 of mounting boss 366. Turning the front edge 396 into slot 372 reduces the probability that the front edge 396 will snag a connecting pin in connector 57 during toner cartridge insertion. Interlock 49 is made from an electrically conductive material, such as stainless steel, and is about 5 mm in width and about 13 mm in length, and 0.3 mm in thickness. About 1.5 mm of the front portion of interlock 49 is inserted into slot 373 of retainer 82. The width of body 495 of interlock 49 is sized so that it will interconnect or short out two adjacent connecting pins in connector 57. The shape and size of the body 495 of interlock 49 is a matter of design choice.

As illustrated in FIG. 4, mounting plane 358 is shown generally parallel to undersurface 308. However, ledges 352, 354 may be angled downwardly from front 310 to rear 311 of retainer 82 so that mounting plane 358 is angled with respect to undersurface 308 or outer surface 119 (see FIG. 11B), to provide greater clearance between a front edge 389 of circuit board 380 and the front of connector 57 as connector 57 initially enters opening 312. This angle may be in the range of about 3 to 8 degrees. Mounting surface 368 would be similarly angled. This arrangement also allows the connecting pins in connector 57 to exert gradually increasing pressure on contact pads 382-385 during insertion into retainer 82 and on body 395 of interlock 49. FIGS. 7 and 8 also illustrate mounting plane 358 being angled. Alternatively, the ends 320, 322, of first and second supports 304, 306 may be angled instead of ledges 352, 354.

Retainers 80, 82, toner cartridge housing 102 including end caps 118, 120, and cleaner housing 204 are molded plastic parts. Any one of a number of plastic materials known to those of skill in the art can be used, such as for example, acrylonitride butadiene styrene (ABS).

As shown, circuit board 380 has a contact surface side 386 on which contacts 382-385 are mounted and a component side 387 on which processing circuitry 45 is mounted. Circuit board 380 has a plurality of spaced, aligned contact or contact pads. As shown example circuit board 380 has four aligned contact pads 382-385 that are mounted on a first surface or contact surface side 386 of circuit board 380 beginning at or adjacent the front or leading edge 389 and extending toward the rear or trailing edge 390 of circuit board 380. As shown there is a small gap between the front ends of contacts 383-385 while the front end of contact 382 extends closer toward the front edge 389 of circuit board 380. This allows for the connection between contact 382 and its corresponding connecting pin in connector 57 to occur first during toner cartridge 35 insertion and to break last during toner cartridge 35 removal. Terminal 382 may be used as a ground terminal. Terminal 383 may be used as a clock terminal to receive clock signals. Terminal 384 may be used as a data and/or control transmission terminal. Terminal 385 may be used as a common collector voltage (Vcc) terminal to supply power. Circuit board 380 may further include computing hardware for storing supply item parameters including but not limited to pages printed, first use date, and supply item ID. The computing hardware may include one or more processors, logic devices, and memory. The computing hardware may further comprise integrated circuits and digital signal processors, in which embedded program code may be stored and executed.

Processing circuitry 45 is mounted on circuit board 380 so as not interfere with the connection between terminals or contact pads 382-385 and their corresponding connecting pins in connector 57. This may be done by placing processing circuitry 45 adjacent to the rear edge 390 on contact or first surface 386 or, as shown, placing processing circuitry 45 on a second surface or component side 387 of circuit board 380 with contact pads 382-385 being fed through circuit board 380 for connection to processing circuitry 45.

Circuit board 380 is mounted in retainer 82 so that contact pads 382-385 are positioned substantially parallel to the insertion direction of toner cartridge 35. The datum point DP formed by the intersection side surfaces 352-2, 356-2 helps to ensure that circuit board 380 and its contacts 382-385 are properly aligned in retainer 82. The connection between the connecting pins of connector 57 and the contact pads 382-385 is a blind connection not visible to a user inserting toner cartridge 35 into imaging unit 32. Further contact pads 382-385 are approximately 1.6 mm wide by about 7 mm long while the connecting pins are approximately 2 mm wide. Given the small sizes of the contact pads and connecting pins, precise alignment between them is necessary to ensure reliable and repeatable electrical connection. Inside image forming device 22 paper dust and toner particles may settle out onto contacts 382-385 and interlock 49, the connecting pins should wipe a portion of the contact pads 382-385 and interlock 49 as connector 57 is inserted into retainer 82.

Defining the insertion direction to be along the X axis, and the vertical direction to be the Y axis, with the Z axis being orthogonal to both the X and Y axes (see FIG. 3), connector 57 when mounted on frame 90 can rotate about the X and Y axes and translate along the Z axis. As shown in FIGS. 6, 11A-16B, on side frame 90, connector 57 is mounted on support 501 that cantilevers into the insertion path through opening 92 in side frame 90 of image forming device 22. Connector 57 houses a plurality of connection pins, as illustrated, six aligned connecting pins 530-535. A fewer or greater number of connecting pins may be used. A biasing member 504, such as spring 504, inserted between the body 502 of connector 57 and frame 90, biases connector 57 away from side frame 90 along the Z axis and into the insertion path of toner cartridge 35 as it travels in channels 96, 97 of frame 90. As shown spring 504 is shown inserted into an interior opening within support 501. Other biasing arrangements may be used.

Figure 9:
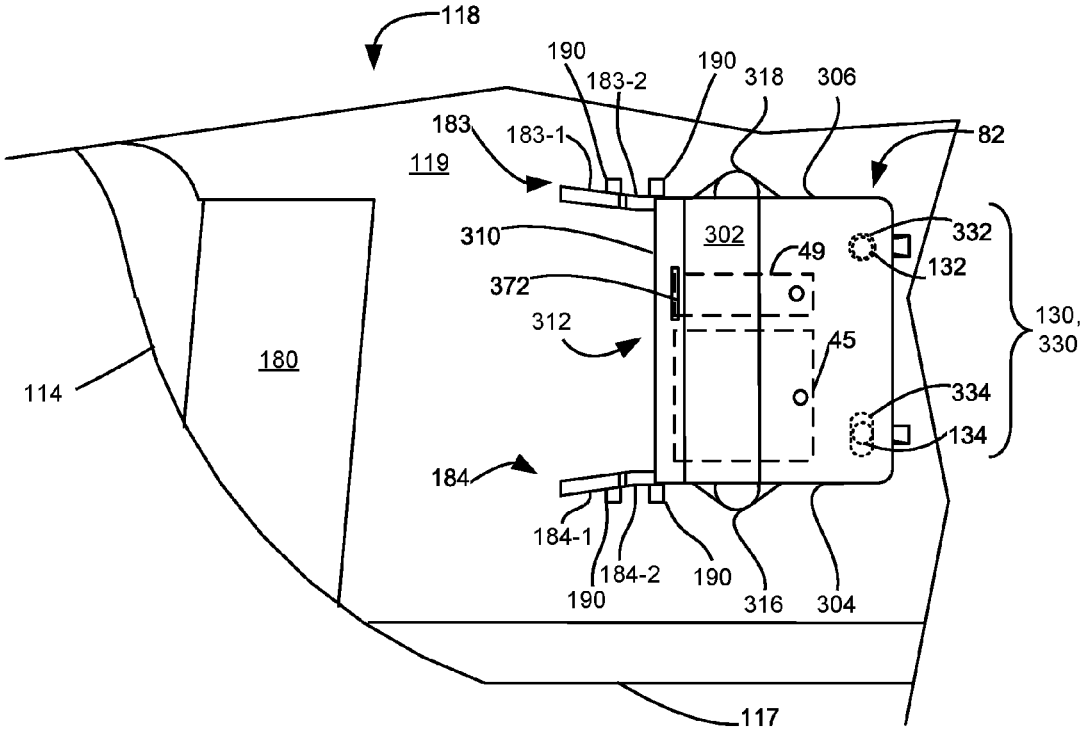
FIG. 9 is a partial side elevation view of the toner cartridge of FIG. 3 showing an example retainer mounted on the end cap thereof.
Figure 10:
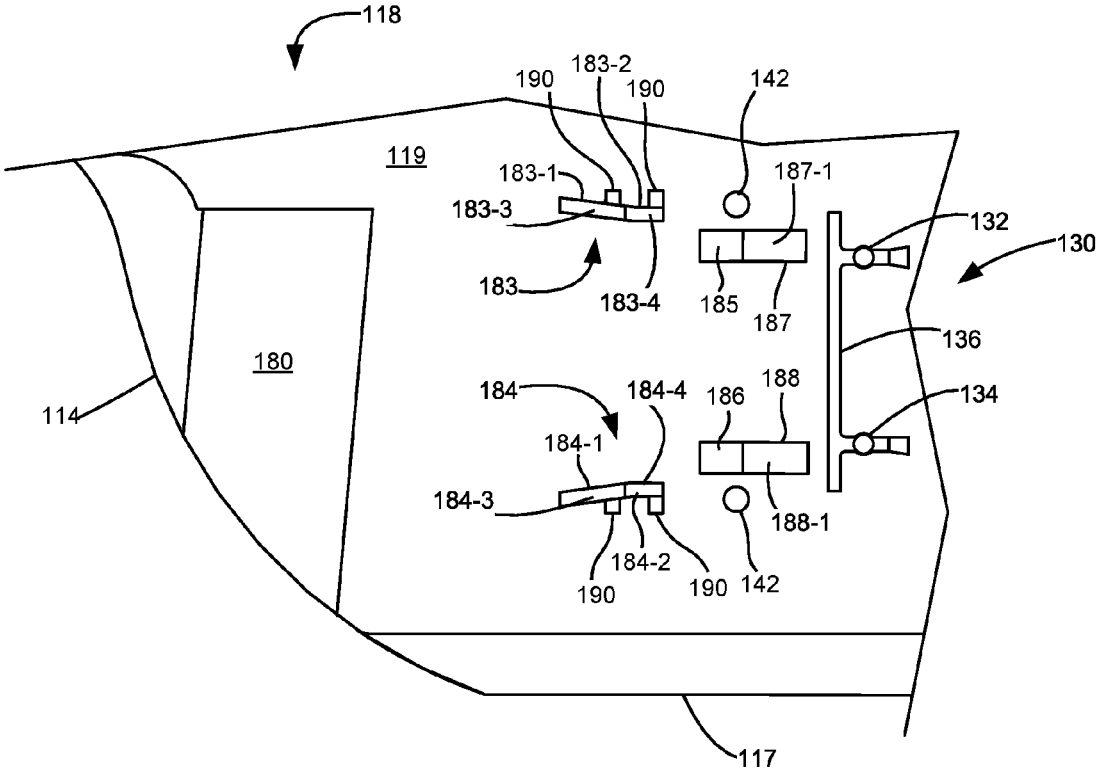
FIG. 10 is a partial side elevation view of the end cap shown in FIG. 9 with the example retainer detached to show positional control features on the toner cartridge.

With reference to FIGS. 9-10, according to an example embodiment, various guides are provided on outer surface 119 of end cap 118 to direct connector 57 into alignment with retainer 82 as toner cartridge 35 is being inserted. These guides include an inclined surface portion or ramp 180 on outer surface 119 of end cap 118 in front of retainer 82. Inclined surface portion 180 inclines outwardly and rearwardly from front wall 114 toward outer surface 119. In one embodiment, the inclined surface portion 180 is angled about 12 degrees with respect to outer surface 119 of the end cap 118. Between inclined surface portion 180 and in approaching the front 310 of retainer 82 are opposing guide walls 183, 184, followed by a pair of cam surfaces or ramps 185, 186, and a corresponding pair of supports 187, 188 extending from outer surface 119 of end cap 118. Cam surfaces 185, 186 and supports 187, 188 are positioned between first and second supports 304, 306 of retainer 82. Opposing guide walls 183, 184 are positioned on opposite sides of opening 312 of retainer 82. Guide walls 183, 184 may each have a chamfered first segment 183-1, 184-1 having an outwardly angled planar surface 183-3, 184-3 with respect to outer surface 119 of end cap 118 and a second segment 183-2, 184-2 having a top planar surface 183-4, 184-4, substantially parallel to outer surface 119. First segments 183-1, 184-1 of guide walls 183, 184 are also angled with respect to retainer 82 and converge inwardly towards the first and second supports 306, 304, respectively, of retainer 82. A plurality of support ribs 190 may be provided on outer surfaces of guide walls 183, 184 for stiffening the guide walls 183, 184 on end cap 118. First segments 183-1, 184-1 aid in funneling connector 57 into alignment with retainer 82.

Supports 187, 188, each have upper planar surfaces 187-1, 188-1 that are spaced away from contact surface 386 of circuit board 380 when the retainer 82 and circuit board 380 are installed. This spacing accommodates a front portion of connector 57 and connecting pins 530-535 when toner cartridge 35 is installed. Sloped cam surfaces 185, 186 extend between outer surface 119 to upper planar surfaces 187-1, 188-1. As shown in FIG. 11B, sloped cam surfaces 185, 186 terminate at an edge spaced away from the contact surface 386 and between a leading edge and a trailing edge of contact surface 386. Planar surfaces 187-1, 188-1 are substantially parallel relative to outer surface 119 and extend from a rear edge of cam surfaces 185, 186 towards the rear wall 116. While a pair of spaced and aligned cam surfaces 185, 186 and corresponding supports 187, 188 are shown a single cam surface and support may also be provided and located more centrally between first and second supports 304, 306.

Figure 5:
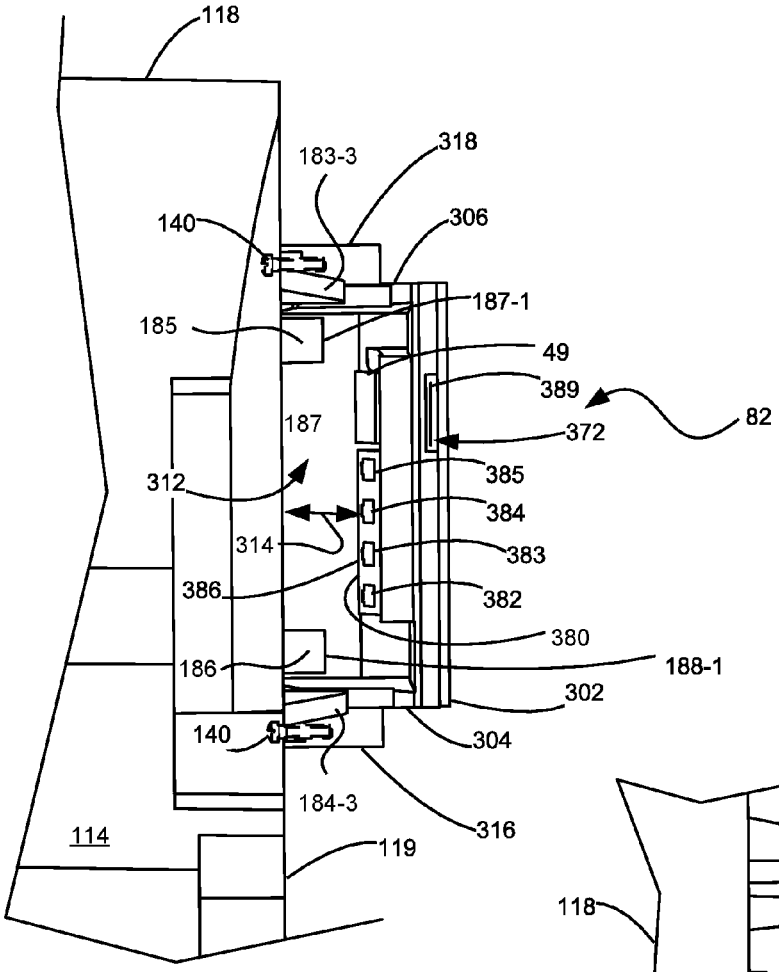
FIG. 5 is a partial side elevation view of the toner cartridge showing an example retainer for a processing device mounted on the end cap of the toner cartridge shown in FIG. 3.
Figure 6:
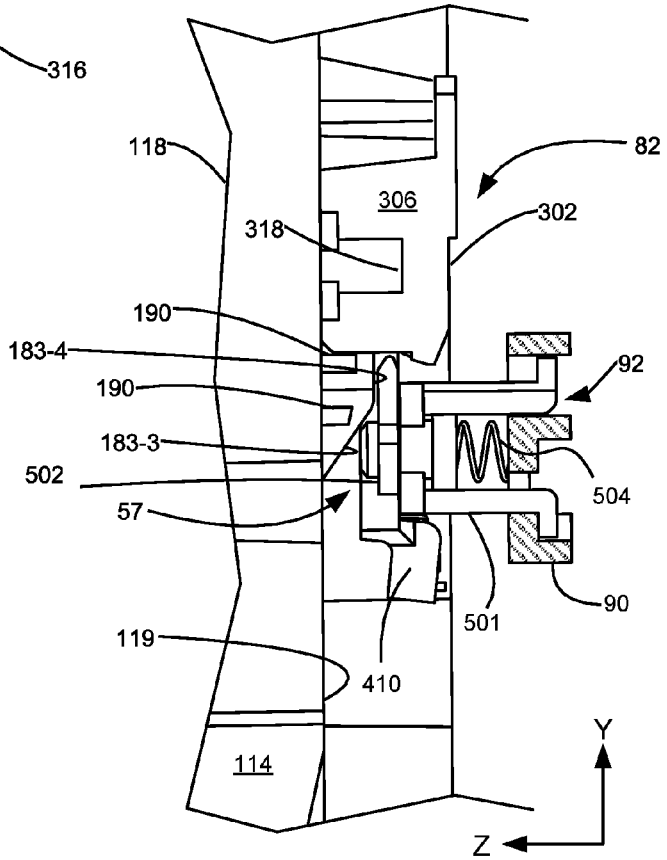
FIG. 6 is a partial top plan view of the example retainer shown in FIG. 5 with a connector inserted.

As shown in FIG. 5, retainer 82 when mounted on end cap 118 forms an opening or pocket 312 therebetween. As shown in FIG. 6, pocket 312 receives connector 57 mounted on a side of frame 90 of image forming device 22 when the toner cartridge 35 is at operational position OP2. Connector 57 is connected to frame 90 by a connecting member 501 that extends from the body 502 of connector 57 and into opening 92 in frame 90. Connecting member 501 may both rotate and tilt, i.e. wobble, within opening 92 allowing connector 57 to do the same. Positioned between frame 90 and body 502 and within connecting member 501 is a biasing member 504 for urging the connector 57 away from frame 90 and into the insertion path of cartridge 35. The body 502 of connector 57 is substantially parallel to frame 90 and outer surface 119 of end cap 118.

FIGS. 11A-16A are sequential views illustrating the insertion of connector 57 into retainer 82 with reference to the X and Y planes during installation of toner cartridge 35 into image forming device 22. These figures show the positions of the connector 57 relative to positional control features of the end cap 118, retainer 82 and the circuit board 380 during connector insertion. FIGS. 11B-16B are sequential views illustrating the insertion of connector 57 into retainer 82 with reference to the X and Z planes. In FIGS. 13A-16A top 302 of retainer 82 has been removed to better view the insertion of connector 57 into retainer 82. The insertion of connector 57 into retainer 82 may be compared to landing an airplane on the deck of an aircraft carrier in that both components, connector 57 and toner cartridge 35, are moving during the insertion process.

Figure 11A:
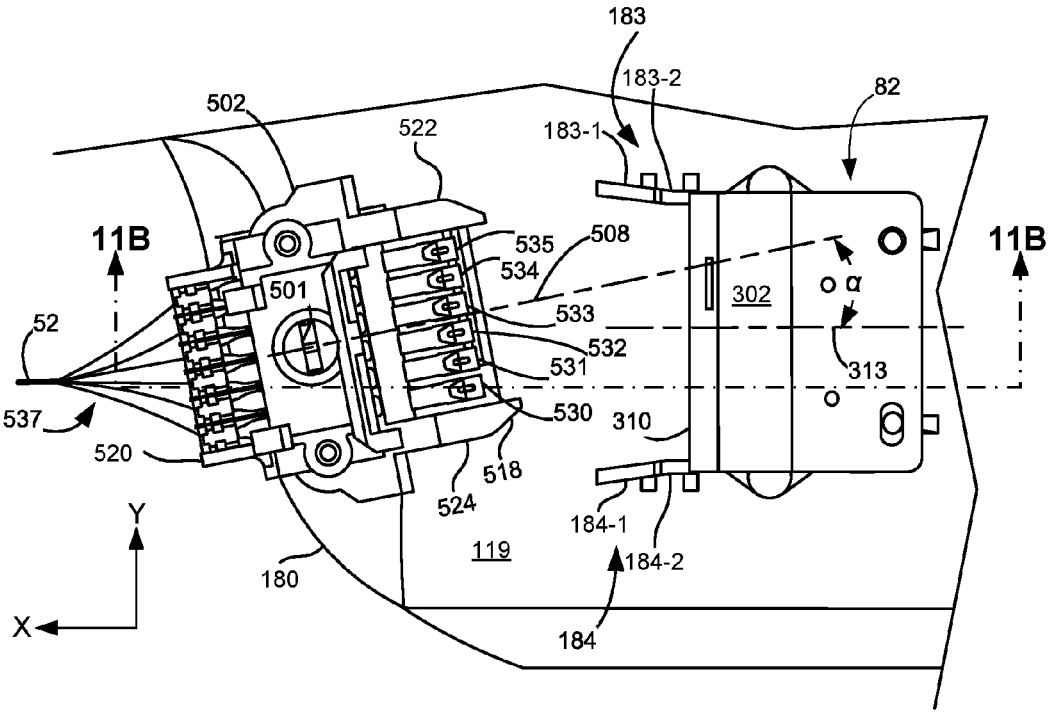
Figure 11B:
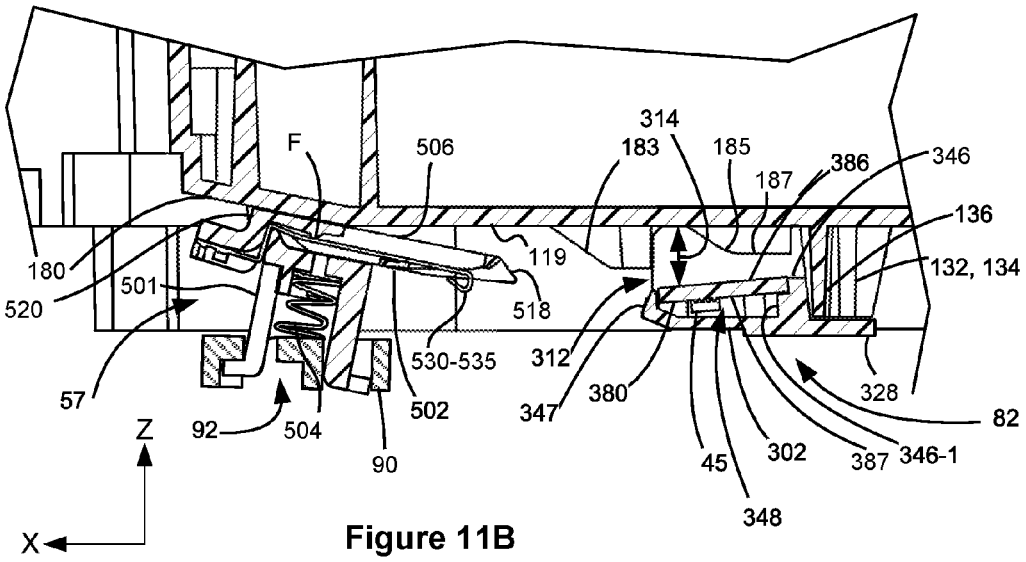

FIGS. 11A and 11B show a back surface 506 of body 502 on connector 57 skidding along the inclined surface 180 during the initial stages of the cartridge insertion process. The inclined surface 180 absorbs the initial impact between the front 518 of connector 57 and cartridge 35 during insertion. Front 518 may be chamfered inwardly from side surfaces 522, 524, and upwardly from back surface 506 as shown. As shown in FIG. 11B, contact between connector 57 and the inclined surface 180 causes connecting member 501 to wobble in opening 92 and compress biasing member 504 allowing the back surface 506 of the connector 57 to align with inclined surface 180. As shown in FIG. 11A, a midline 508 of connector 57 is not aligned with a midline 313 of retainer 57 and is shown forming an acute angle α therewith. As illustrated there, due to the weight of the connecting wires (not shown) that would be attached to the rear end 520 of connector 57, connector 57 is rotated slightly upward such that the midline 508 of connector 57 is at an angle α with respect to the midline 313 of retainer 82. Connector 57 may also be rotated downward. Connecting member 501 and opening 92 limit the rotation of connector 57 about midline 313 to be in the range of 45 degrees or less about midline 313. Also wires 537 that comprise communications link 52 connected to each of the connecting pins 530-535 at the rear end 518 would also limit the rotational arc through which connector 57 may move when not inserted into retainer 82. For clarity purposes, wires 537 are not shown in FIGS. 12A-16A. Connecting pins 530-535 are mounted on body 502 in as overhung beams so as to pivot about fulcrum F. Connecting pins 530-535 may also be mounted in a cantilever manner.

Figure 12A:
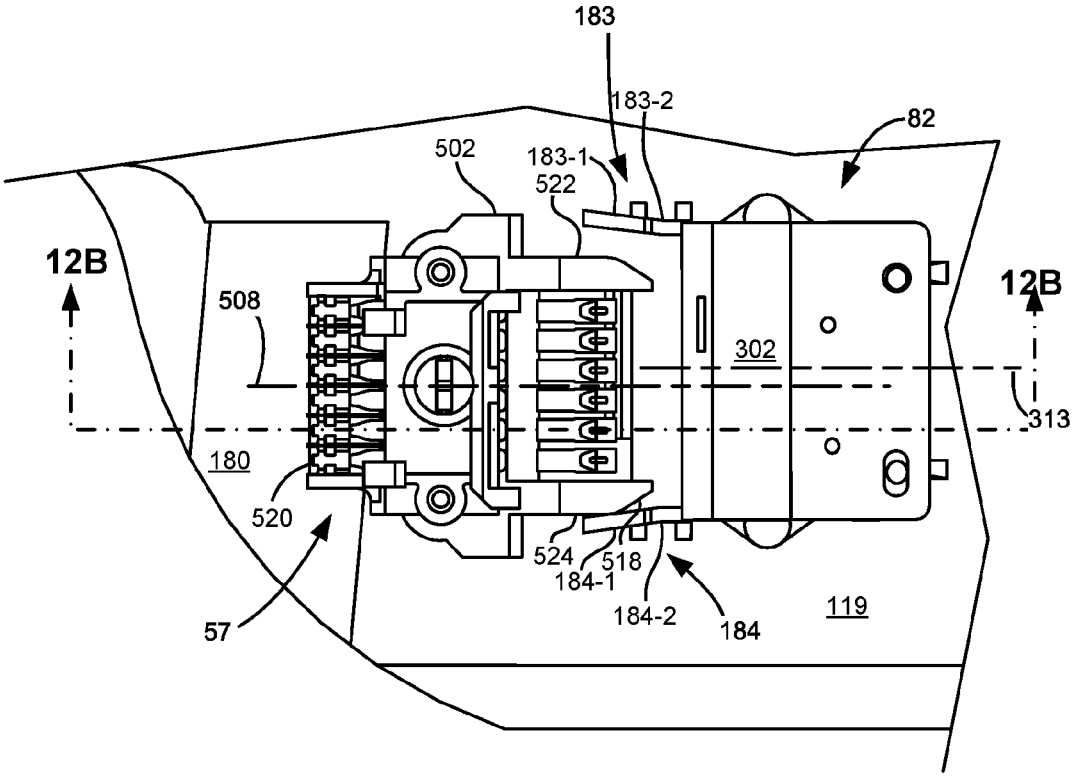
FIGS. 12A and 12B show a front end of the connector engaging a first segment of side guide walls positioned on the end cap of the toner cartridge in front of the retainer as the insertion of the toner cartridge continues.
Figure 12B:
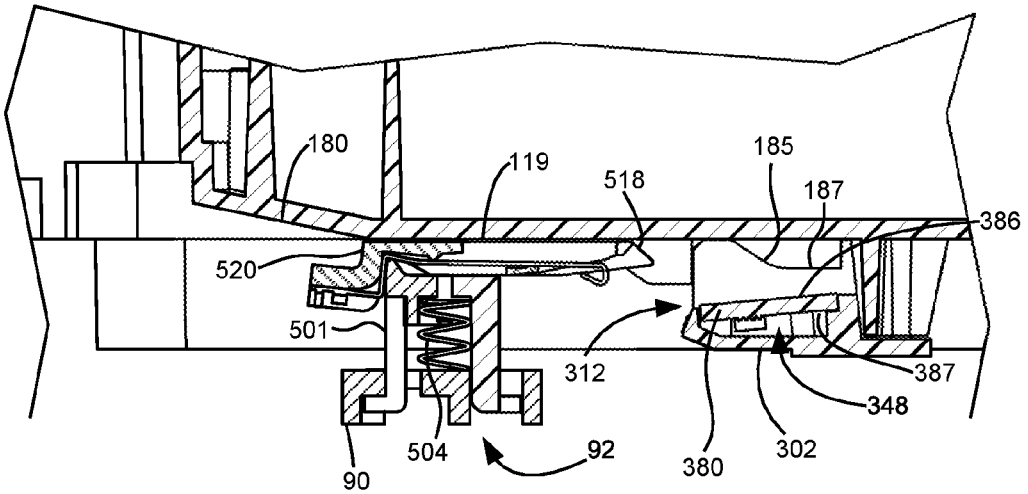

As rear end 520 of connector 57 moves past the upper edge of inclined surface 180, back surface 506 of connector 57 aligns with outer surface 119. During further insertion of the toner cartridge 35, at least one of the guide walls 183, 184 contacts at least one of side surfaces 522, 524, respectively, of the connector 57 such that the connector 57 rotates and becomes aligned vertically with respect to the midline 313 of opening 312 and retainer 82. As shown in FIGS. 12A, 12B, side surface 524 of connector 57 contacts guide wall 184. The midline 508 of connector 57 is substantially parallel to the midline 313 of retainer 82 but is offset from midline 313. As insertion of toner cartridge 35 continues, guide walls 183, 184 funnel connector 57 so that the midline 508 and midline 313 are substantially coincident as connector 57 enters into retainer 82.

Figure 13A:
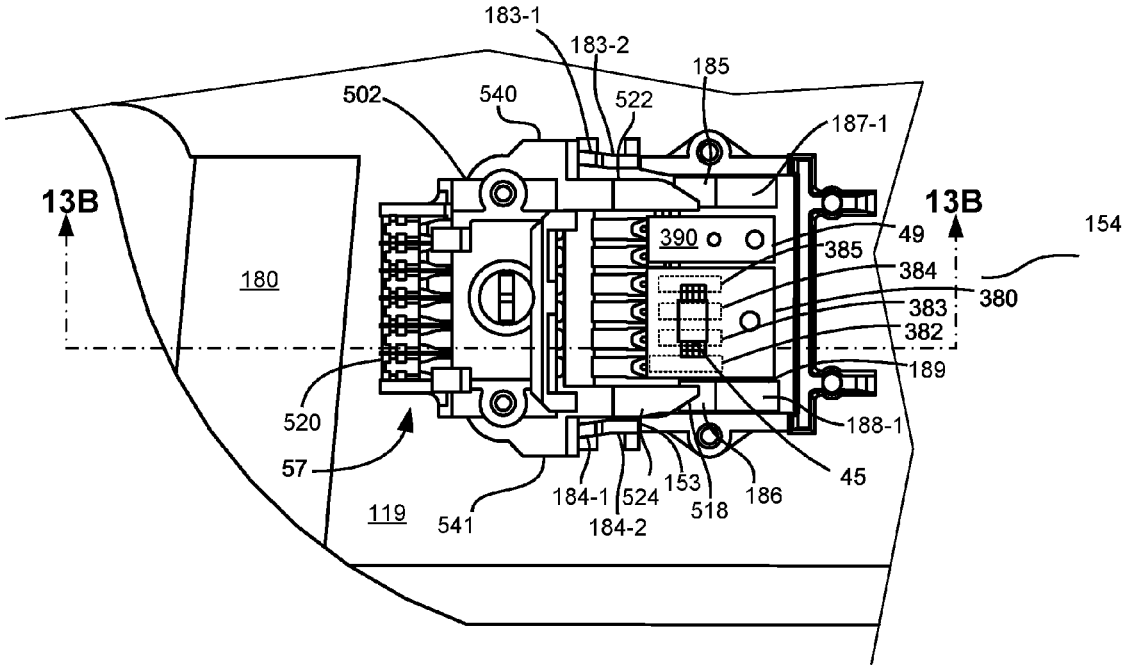
Figure 13B:
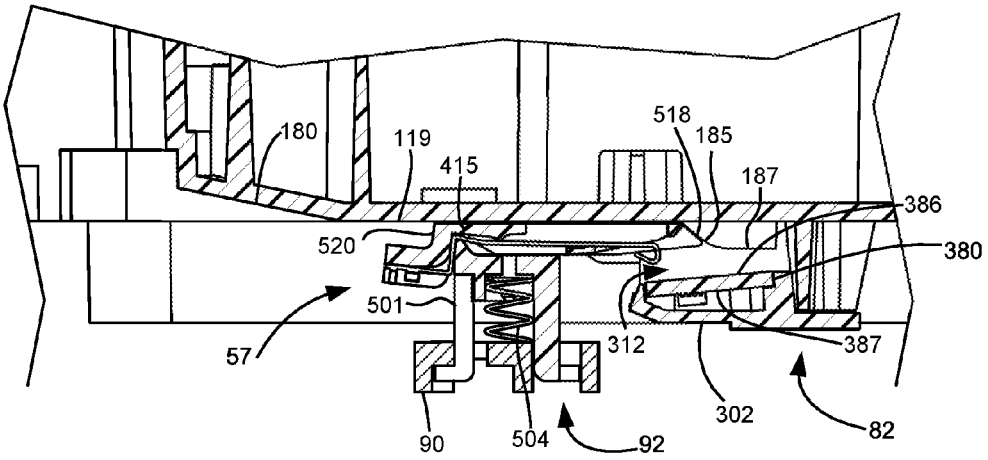

FIGS. 13A, 13B show the front end 518 of the connector 57 beginning to engage cam surfaces 185, 186. As the front 518 of the body 502 of connector 57 is lifted away from outer surface 119 of end cap 118 by cam surfaces 185, 186, the connecting pins 530-535 of connector 57 are guided into contact with contact pads 382-385 of circuit board 380 and body 390 of safety interlock 49. Support 501 allows the body 502 of connector 57 to rotate as the front end 518 contacts with cam surfaces 185, 186. Wing guides 540, 541 extending from side surfaces 522, 524, respectively, of connector 57 begin to engage the inclined surfaces 183-3, 184-3, respectively, of guide walls 183, 184 as toner cartridge 35 continues to be inserted. As toner cartridge insertion continues the wing guides 540, 541 come to rest atop planar surfaces 183-4, 184-4, respectively, of guide walls 183, 184, as shown in FIG. 14B, such that the body 502 of connector 57 returns to being substantially parallel to outer surface 119 or the undersurface 308 of retainer 82. This lifts rear end 520 of connector 57 off of outer surface 119 positioning it closer toward top 302 of retainer 82.

Figure 14A:
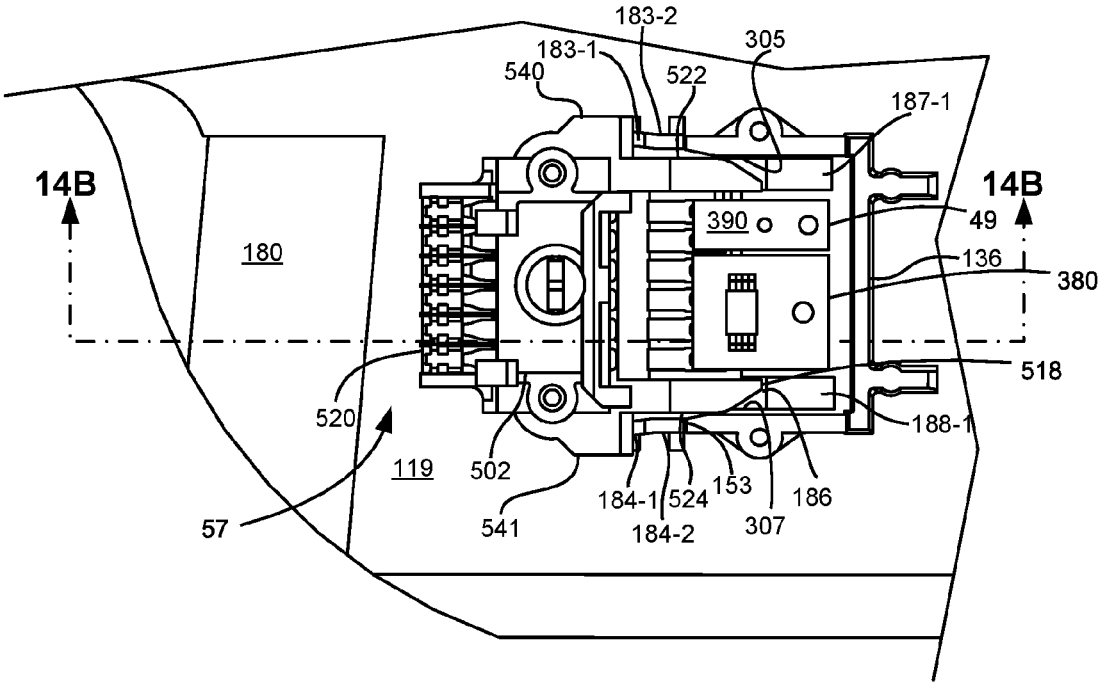
FIGS. 14A and 14B show wing guides on the sides of the connector engaging an inclined surface of the first segment of each of the side guide walls to lift the rear of the connector away from the end cap and toward the circuit board of the processing circuitry.
Figure 14B:
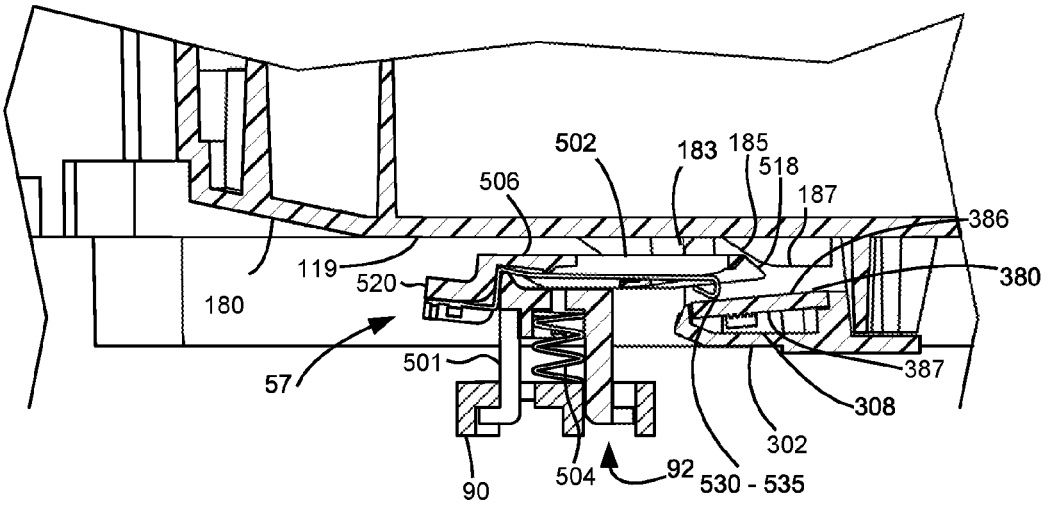

FIGS. 14A and 14B show the front end 518 of the connector 57 approaching planar surfaces 187-1, 188-1 and connecting pins 530-535 beginning to touch the contacts on contact surface 386 of circuit board 380 and the body 390 of interlock 49. Further insertion of the toner cartridge 35 moves the body of 502 into engagement with planar surfaces 187-1, 188-1 thereby making electrical connections with the terminals 382-385 of circuit board 380 and body 390 of interlock 49 and respective connection pins 530-535 of connector 57. As shown in FIG. 14A, side surfaces 522, 524 of body 502 of connector 57 slidably engage with respective inner surfaces 307, 305 of supports 306, 304 vertically aligning the connector 57 along the Y axis within retainer 82. At this point connecting pins 530-533 are located about front to back midlines of contact pads 382-385 and connecting pins 534-535 are located about a front to back midline of body 390 of interlock 49. Planar surfaces 187-1, 188-1 locate body 502 of connector 57 at its final operational position with respect to outer surface 119 along the Z axis and circuit board 380. From this point further insertion of the toner cartridge 35 results to the connecting pins 530-535 sliding across the respective terminals of the circuit board 380 and body 390 of interlock 49. This sliding motion creates a wiping action intended to scrape off an oxidation or contamination layer and enhance the reliability of the engagement between the connecting pins 530-535 and contact pads 382-385 and body 390, respectively. In one embodiment, the ground connecting pin 530 a travels a distance of about 4.7 mm, and the non-ground connecting pins 531-535 travel a distance of about 2 mm before connector 57 is fully seated in retainer 82.

Figure 15A:
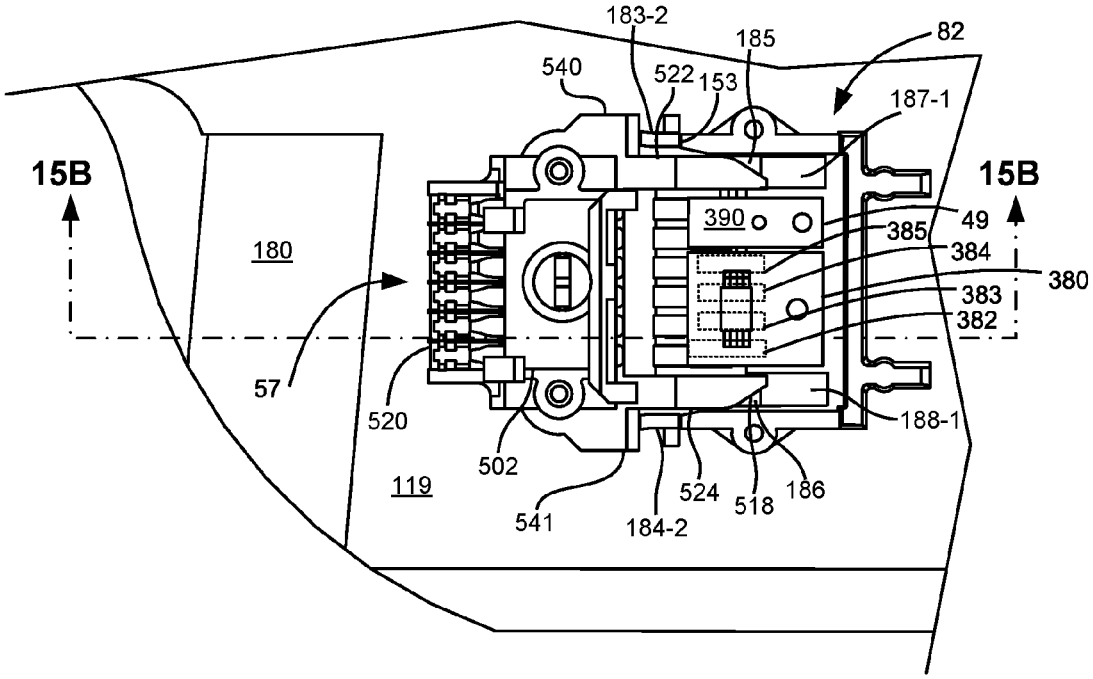
FIGS. 15A and 15B show the connector pins of the connection initiating contact with the terminals on the circuit board of the processing circuitry as insertion continues.
Figure 15B:
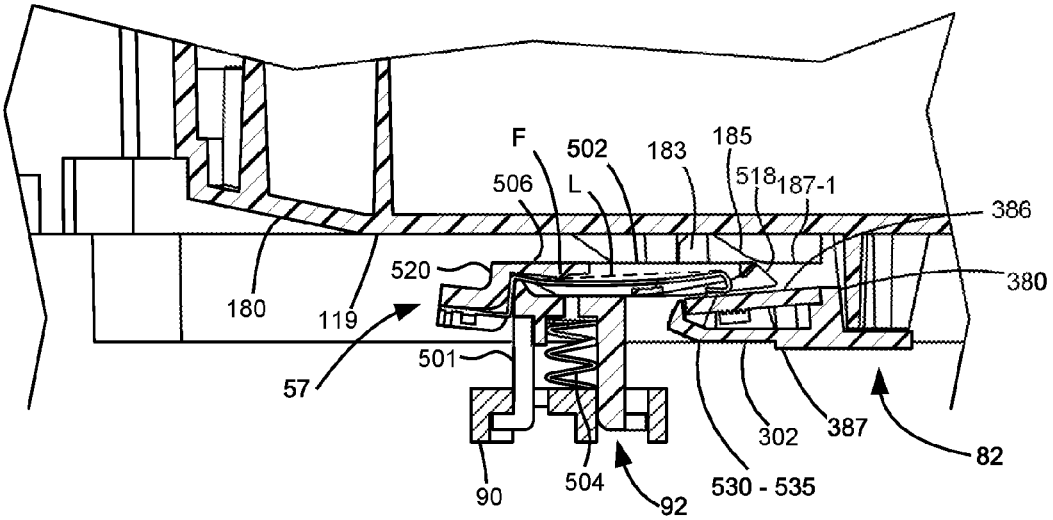

In FIGS. 15A, 15B, connector 57 is nearing its fully inserted position within retainer 82. As shown by dashed line L connecting pins 530-535 have begun to deflect about fulcrum F (along the Z axis as shown) due to back surface 506 of body 502 coming up onto planar surfaces 187-1, 188-1. This deflection increases the contact force between connecting pins 530-535 and circuit board 380 and interlock 49. Chamfering along the front 518 of body 502 assist in guiding body 502 into position atop planar surfaces 187-1, 188-1.

Figure 16A:
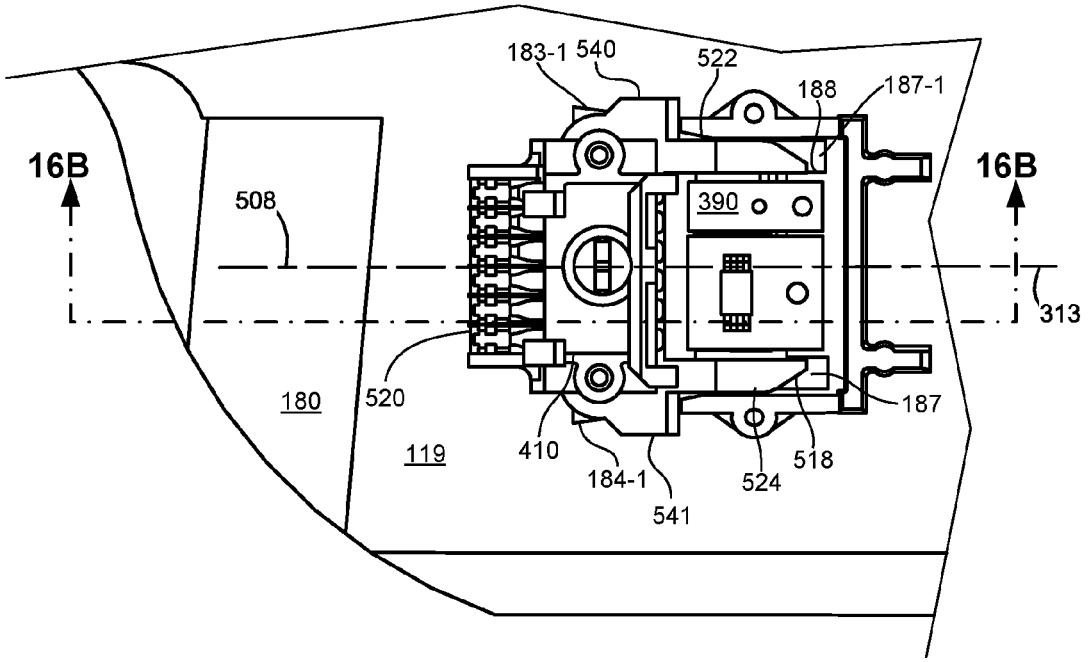
Figure 16B:
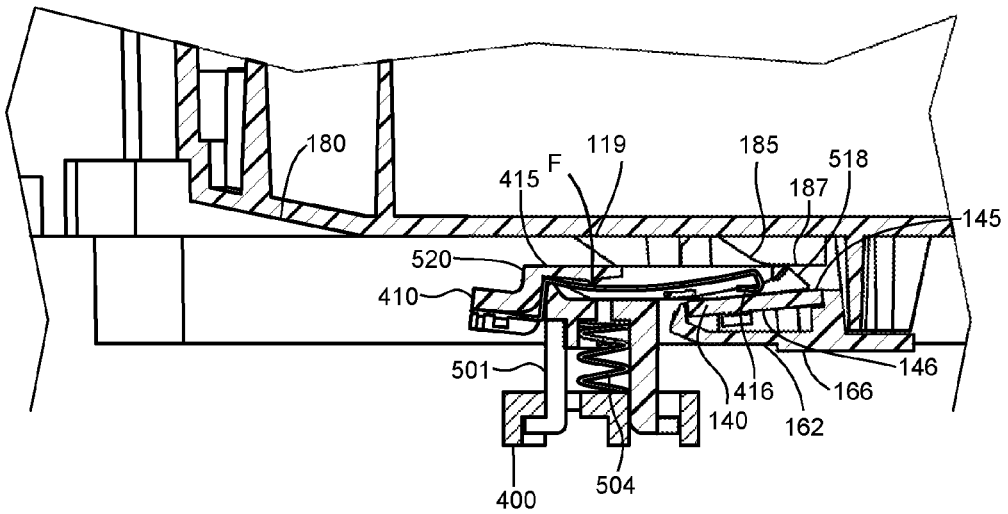

FIGS. 16A and 16B show the final operating position of connector 57 within retainer 82. In the final operating position, back surface 506 of connector 57 aligns with the planar surfaces 187-1, 188-1, side surfaces 522, 524 of connector 57 align with second and first supports 306, 304. Connecting pins 530-535 have reached their final deflected position about fulcrum F due to back surface 506 of body 502 coming up onto planar surfaces 187-1, 188-1. In the final operating position, further insertion of connector 57 into retainer 82 is prevented by the abutment of the wing guides 540, 541 with the front of second and first supports 506, 504, respectively. At this position, midline 508 of connector 57 is collinear with midline 313 of retainer 82.

As mentioned above, the features of retainers 80, 82 are similar. As shown in FIG. 3, retainer 80 may be fastened onto the side surface 219 of imaging unit 32 from the outside, using fasteners such as screws 240. Further, according to an example embodiment, a ramp 280 is positioned prior to the entrance 252 of the pocket formed by retainer 80 and side surface 219. In one embodiment, the ramp 280 may be formed by a plurality of aligned and spaced apart inclined ribs 281. In another embodiment, ramp 280 comprises a single rib having an inclined surface. Positioned behind ramp 280 and ahead of retainer 80 is an inclined surface 282. Ramp 280 and surface 282 help to lift connector 55 into contact with the circuit board mounted to the undersurface of the top of retainer 80. As viewed in FIG. 3, upper and lower guide walls 283, 284 may be provided on inclined surface 282 and function in a similar manner to guide walls 183, 184.

Figure 17A:
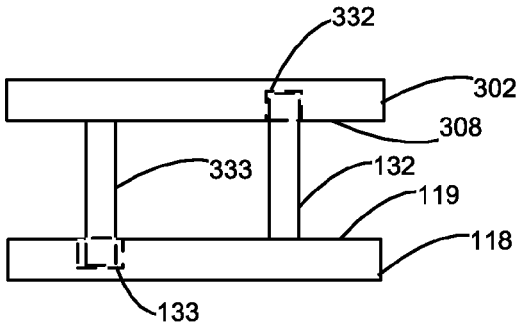
FIGS. 17A-17E illustrate various alternate configurations for the alignment devices between the retainers and the toner cartridge or imaging unit.
Figure 17C:
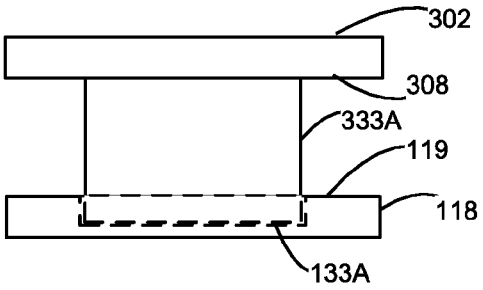
Figure 17B:
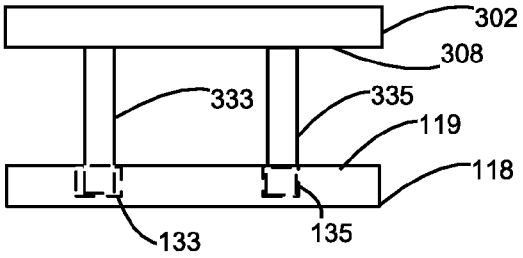
Figure 17D:
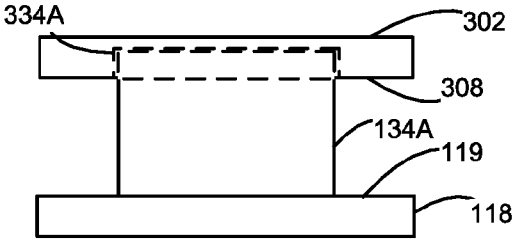
Figure 17E:
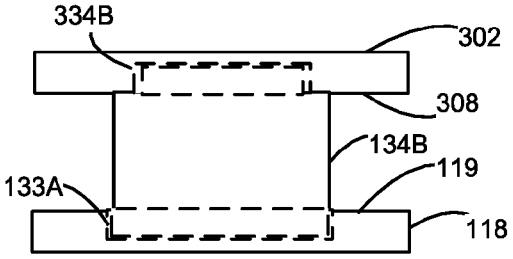

FIGS. 17A-17E illustrate various alternate configurations for the alignment devices 130, 230, 330, 430 between the retainers 80, 82, and the toner cartridge 35 or imaging unit 32. FIGS. 17A-17E illustrate these configurations as between the retainer 82 and end cap 118 of toner cartridge 35. As will be readily observed any of such illustrated configurations may be used between retainer 80 and imaging unit 32. In FIG. 17A post 132 extends from outer surface 119 of end cap 118 into hole 332 as previously described. However, as shown post 333 extends from undersurface 308 of top 302 into a slot 133 in end cap 118. In FIG. 17B post 333 and slot 133 are as previously described as shown in FIG. 17A. A second post 335 extends from the undersurface 308 of top 302 into hole 135 provided in end cap 118. In FIGS. 17C-17E a single alignment device is illustrated. In FIG. 17C post 333A extends from undersurface 308 of top 302 and engages with slot 133A provided in the outer surface 119 of end cap 118. Post 333A is generally rectangular and planar and fits closely with slot 133A. The width of post 333A is a matter of design choice. Other shapes for post 333A and slot 133A such as a curve, or a chevron may be used. FIG. 17D illustrates a reverse arrangement of post and slot from that shown in FIG. 17C. In FIG. 17D, a single post 134A extends outwardly from outer surface 119 of end cap 118 and its end is received into corresponding slot 334A provided in the undersurface 308 of top 302. In FIG. 17E another alternate arrangement using a single post is shown. In FIG. 17E post 134B, similar to post 134A is received at each end thereof into slots 133A in the outer surface 119 of end cap 118 and slot 334B in the undersurface 308 of top 302. The opposite ends of post 134 may be of the same size or may be of different sizes to ensure that post 134B is properly oriented when its ends are inserted into their respective slots. Slots 133A and 334B are each sized to receive the correspondingly sized end of post 134B. As shown slot 334B and the corresponding end of post 134B are shown as being smaller than slot 133A and the other end of post 134B.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

The invention claimed is:

1. An electrophotographic image forming device, comprising:

a replaceable unit including:

a housing having an internal reservoir for storing toner; and a circuit board retainer on an exterior surface of the housing, the retainer including:

a top having an undersurface having first and second supports extending away from the undersurface of the top toward a bottom of the retainer and extending in a direction from a front of the retainer to a rear of the retainer, the front of the retainer facing a direction of insertion of the replaceable unit into the image forming device;

a pair of opposed side walls on the undersurface of the top, the opposed side walls positioned intermediate the first and second supports and extending away from the undersurface of the top toward the bottom of the retainer and extending in the direction from the front of the retainer to the rear of the retainer, each opposed side wall includes a bottom surface that faces toward the bottom of the retainer and is spaced closer to the top of the retainer than bottom surfaces of the first and second supports are to the top of the retainer;

a rear wall positioned on the undersurface of the top transversely to the pair of opposed side walls and adjacent the rear of the retainer, the rear wall extending away from the undersurface of the top toward the bottom of the retainer, the rear wall includes a bottom surface that faces toward the bottom of the retainer and is spaced closer to the top of the retainer than the bottom surfaces of the first and second supports are to the top of the retainer;

a circuit board seated against the bottom surfaces of the opposed side walls and the rear wall, the circuit board including processing circuitry and electrical contacts, the electrical contacts of the circuit board facing toward the bottom of the retainer; and the top and the first and second supports form an opening at the front of the retainer sized to receive an electrical connector of the image forming device for mating with the circuit board when the replaceable unit is installed in the image forming device.

2. The electrophotographic image forming device of claim 1, wherein one of the opposed side walls comprises a plurality of deformable ribs extending toward the other side wall of the pair of opposed side walls, the plurality of deformable ribs exerting a force on the circuit board to bias the circuit board against the other side wall of the pair of opposed side walls.

3. The electrophotographic image forming device of claim 2, wherein the bottom surface of each of the pair of opposed side walls and the rear transverse wall includes a recessed ledge and the circuit board is seated against each recessed ledge.

4. The electrophotographic image forming device of claim 2, wherein a front transverse wall depending from the undersurface of the top is provided opposite the rear transverse wall, the front transverse wall comprising a second plurality of deformable ribs extending toward the rear transverse wall, the second plurality of deformable ribs exerting a second force along a front edge of the circuit board to bias the circuit board against the rear transverse wall.

5. The electrophotographic image forming device of claim 1, wherein the bottom surfaces of the opposed side walls are angled toward the bottom of the retainer going from the front of the retainer to the rear of the retainer similarly angling the circuit board toward the bottom of the retainer going from the front of the retainer to the rear of the retainer.

6. The electrophotographic image forming device of claim 1 wherein a mounting boss depends from the undersurface of the top between the opposed side walls and a bottom surface of the mounting boss is coplanar with the bottom surfaces of the opposed side walls and the rear wall, the mounting boss receiving a fastener retaining the circuit board on the retainer.

7. An electrophotographic image forming device, comprising:

a replaceable unit including:

a housing having an internal reservoir for storing toner; and a circuit board retainer on an exterior surface of the housing, the retainer including:

a top having an undersurface having first and second supports extending away from the undersurface of the top toward a bottom of the retainer and extending in a direction from a front of the retainer to a rear of the retainer, the front of the retainer facing a direction of insertion of the replaceable unit into the image forming device, the bottom of the first and second supports positioned proximate the exterior surface of the housing;

a pair of opposed side walls on the undersurface of the top, the opposed side walls positioned intermediate the first and second supports and extending away from the undersurface of the top toward the bottom of the retainer and extending in the direction from the front of the retainer to the rear of the retainer, each opposed side wall includes a bottom surface that faces toward the bottom of the retainer and is spaced apart from the bottom of the retainer;

a circuit board seated against the bottom surfaces of the opposed side walls, the circuit board including processing circuitry and electrical contacts, the electrical contacts of the circuit board facing toward the bottom of the retainer; and the top and the first and second supports form an opening at the front of the retainer sized to receive an electrical connector of the image forming device for mating with the circuit board when the replaceable unit is installed in the image forming device.

8. The electrophotographic image forming device of claim 7, wherein the first and second supports are positioned to contact the electrical connector of the image forming device and align the electrical connector of the image forming device with the circuit board for electrical interconnection therebetween when the replaceable unit is inserted into the image forming device.

9. The electrophotographic image forming device of claim 7, wherein the replaceable unit includes a first alignment device on the bottom of the first support and a second alignment device on the bottom of the second support engaging with a corresponding first and second alignment device on the housing and aligning the retainer on the housing.

10. The electrophotographic image forming device of claim 9, wherein the first alignment device includes a first alignment hole on the bottom of the first support and the second alignment device includes a second alignment hole on the bottom of the second support.

11. The electrophotographic image forming device of claim 7, wherein the replaceable unit includes a first mounting device on the bottom of the first support and a second mounting device on the bottom of the second support mounting the retainer on the exterior surface of the housing.

12. The electrophotographic image forming device of claim 11, wherein the first mounting device includes a first fastener receiving hole on the bottom of the first support and the second mounting device includes a second fastener receiving hole on the bottom of the second support.

13. The electrophotographic image forming device of claim 7, wherein the replaceable unit includes a mounting boss on the undersurface of the top extending away from the undersurface of the top intermediate the opposed side walls and proximate the rear of the retainer retaining the circuit board on the retainer.

14. The replaceable unit of claim 7, wherein the bottom surface of each opposed side wall includes a recessed ledge, the circuit board is seated against each recessed ledge.

15. An electrophotographic image forming device, comprising:

a replaceable unit including:

a housing having an internal reservoir for storing toner; and a circuit board retainer on an exterior surface of the housing, the retainer including:

a top having an undersurface having first and second supports extending away from the undersurface of the top toward a bottom of the retainer and extending in a direction from a front of the retainer to a rear of the retainer, the front of the retainer facing a direction of insertion of the replaceable unit into the image forming device, the bottom of the first and second supports positioned against the exterior surface of the housing;

a mounting platform on the undersurface of the top intermediate the first and second supports and spaced apart from the bottom of the retainer;

a circuit board mounted on the mounting platform, the circuit board including processing circuitry and electrical contacts;

a first fastener receiving hole on the bottom of the first support and a second fastener receiving hole on the bottom of the second support mounting the retainer on the exterior surface of the housing; and the top and the first and second supports form an opening at the front of the retainer sized to receive an electrical connector of the image forming device for mating with the circuit board when the replaceable unit is installed in the image forming device, wherein frontmost portions of the top and the first and second supports form an entrance to the opening.

16. The electrophotographic image forming device of claim 15, wherein the mounting platform includes a pair of opposed side walls on the undersurface of the top, the opposed side walls positioned intermediate the first and second supports and extending away from the undersurface of the top toward the bottom of the retainer and extending in the direction from the front to the rear of the retainer.

17. The electrophotographic image forming device of claim 16, wherein the replaceable unit includes a mounting boss on the undersurface of the top extending away from the undersurface of the top intermediate the opposed side walls and proximate the rear of the retainer retaining the circuit board on the retainer.

18. The electrophotographic image forming device of claim 16, wherein the opposed side walls each have a recessed ledge formed in their distal ends relative to the undersurface of the top, a respective edge of the circuit board seated on each recessed ledge.

19. The electrophotographic image forming device of claim 15, wherein the first and second supports are positioned to contact the electrical connector of the image forming device and align the electrical connector of the image forming device with the circuit board for electrical interconnection therebetween when the replaceable unit is inserted into the image forming device.

20. The electrophotographic image forming device of claim 15, wherein the replaceable unit includes a first alignment hole on the bottom of the first support and a second alignment hole on the bottom of the second support engaging with a corresponding first and second alignment projection on the housing and aligning the retainer on the housing.

* * * * *